US006125603A

United States Patent [19]

Amore

[11] Patent Number: 6,125,603

[45] Date of Patent: Oct. 3, 2000

[54] CONSTRUCTION SYSTEM OF CORRUGATED EDGE SECTIONS AND ENGAGING CONNECTING DEVICES

[76] Inventor: Gregorio Amore, c/ da Porticatazzo, Residence Porticatello snc, 95040 Motta S. Anastasia, Catania, Italy

[21] Appl. No.: 09/029,020

[22] PCT Filed: Aug. 1, 1996

[86] PCT No.: PCT/IT96/00156

§ 371 Date: Feb. 20, 1998

§ 102(e) Date: Feb. 20, 1998

[87] PCT Pub. No.: WO97/08400

PCT Pub. Date: Mar. 6, 1997

[30] Foreign Application Priority Data

Aug. 22, 1995 [IT] Italy ..... FI95A190

[51] Int. Cl.[7] ..... E04B 1/24

[52] U.S. Cl. ..... 52/653.1; 52/731.2; 52/733.2

[58] Field of Search ..... 52/170, 653.1, 52/731.2, 731.4, 732.1, 736.4, 737.5, 733.2; 29/897.3, 897.31, 897.312, 897.35

[56] References Cited

U.S. PATENT DOCUMENTS

| | | | |
|---|---|---|---|
| 4,069,638 | 1/1978 | Hasselqvist et al. | 52/731.2 X |
| 4,948,313 | 8/1990 | Zankovich . | |
| 5,285,615 | 2/1994 | Gilmore | 52/733.2 |

FOREIGN PATENT DOCUMENTS

| | | |
|---|---|---|
| CT92A0016 | 5/1992 | Italy . |
| 1 503 588 | 2/1978 | United Kingdom . |
| WO 96/06240 | 2/1996 | WIPO . |

*Primary Examiner*—Richard Chilcot
*Attorney, Agent, or Firm*—McGlew and Tuttle, P.C.

[57] ABSTRACT

Two or more elementary sections are permanently assembled together to form continuous longitudinal slots with their longitudinal edges facing inwards and each inclined towards the opposite edge so that they converge inwardly. Fixing devices are provided and comprise a receiving matrix or plate forming a channel with walls inclined in the same way as the edges and one or more locking plugs or plates which also have lateral walls inclined in the same way as the edges. The devices may be fixed along the slots to grip the edges by a screw between matrices and plugs. The longitudinal edges of the elementary sections have corrugations corresponding to corrugations which are present in the walls of the matrices and in the lateral walls of the plugs.

20 Claims, 25 Drawing Sheets

CONSTRUCTION SYSTEM OF CORRUGATED EDGE SECTIONS AND ENGAGING CONNECTING DEVICES

TECHNICAL FIELD

The invention relates to metal supporting structures which are used in the field of metal structural work in the broadest sense, including the following types:

I) MEDIUM-HEAVY STRUCTURES:

a) Multi-storey buildings b) Sheds with and without tracks for bridge cranes c) Hangars d) Roofing for sports facilities e) Awnings and canopies f) Staircases, footbridges and intermediate floors g) Single-rail tracks for lifting equipment h) Towers for antennae of various kinds i) Pylons for main electrical power lines l) Supporting latticework for aqueducts, drains, gas pipelines, etc.

m) Railway line electrification masts n) Supporting columns and frameworks for road signs and advertising hoardings o) Space frames p) Guard rails q) Pillars for square sectional silos r) Supporting structures for rubber roller conveyor belts II) SUPPORTING STRUCTURES (light)

a) Sectional components for frames b) Fence posts (light: for mesh and barbed wire) (heavy: for panels and gates)

c) Sectional components for automatic and manually-operated gates d) Industrial scaffolding e) Light scaffolding for interior decoration f) Sectional single-rail tracks for factory doors g) Composite sections for installation on lorries with sliding covers h) Railings and banisters i) Stands for fairs, plain or with small-scale space frames l) Continuous anchorages to be cast into reinforced concrete with section and anchor bolts m) Ladders.

Single and composite sections may be made with different geometries but of the same types, permitting the use of fixing devices without the need to drill or weld the sections.

BACKGROUND ART

GB-A-1503588 discloses a structural profiled element, obtained by the assembly of two or four simple profiled elements. The fixed member discloses in GB-A-1503588 does not serve as a connection means between the simple profiled elements in order to assemble the structural profiled elements.

GB-A-1503588 discloses a structural profiled element, obtained by the assembly of two or four simple profiled elements. The fixed member disclosed in GB-A-1503588 does not serve as a connection means between the simple profiled elements in order to assemble the structural profiled elements.

Metal structures comprising cold-formed sections which may be single or composites of elementary sections, as well as fixing devices for connections, joints or special pieces, are disclosed in Italian patent application CT92A 000016 of 04.05.1992. A metal supporting structure of the aforesaid type comprises:

a cold-formed section which may be single or a composite of a plurality of elementary sections, which are permanently assembled together to form continuous longitudinal slots with their longitudinal edges facing inwards and each inclined with respect to the opposite edge so that they converge inwardly;

and fixing devices, having a receiving matrix or plate forming a channel with walls inclined in the same way as the said edges, and one or more locking plugs or plates which also have lateral walls inclined in the same way as the said edges; the devices may be fixed along the said slots to grip the edges by screw means between matrices and plugs, with a preliminary one-off operation of deformation of the edges—which are originally rectilinear—using the matrices and plugs.

DISCLOSURE OF THE INVENTION

The structure according to . the present invention is defined in claim 1.

In practice, the longitudinal edges of the elementary sections have the corrugations along their whole length.

The said corrugations are repeated at a constant interval corresponding to the interval of the multiple corrugations present in the walls of the matrices and in the lateral walls of the plugs.

The interval, the depth and the radii of curvature of the corrugations are proportional to the thickness of the sections, and therefore the forgings will have dimensions, intervals, depths and radii of curvature to receive the corrugated sheets according to the thickness of the sections.

Further characteristics of the invention are specified in the dependent claims.

The previous solutions mentioned above form the fastening by pressing the plug into the matrix until the edges of the elementary sections are deformed, creating a single fastening or key on a one-off basis, by means of lengthy and expensive operations, with structural limitations and with large sizes of certain elements.

According to the present invention, however, the corrugation of the edges of each individual preformed section is created directly during the production of the elementary sections, during the forming process and without any significant additional costs.

This has many considerable and evident advantages, including the following.

The forgings, in other words the plugs and matrices, can be made lighter since they do not have to withstand the stresses produced in the phase of stamping the key, which would be done in the prior art by deforming the rectilinear edges of the sections; consequently, the dimensions of the screws subjected to the stresses produced by the stamping of the key into the edges of the section will also be reduced by a suitable amount, these screws being only required to withstand the forces of connection and not the (larger) forces of the cold deformation of the edges.

There is also a considerable saving of time in the assembly of the forgings (matrices and plugs), since it is no longer necessary to stamp the key into the edges of the section (by clamping the plug, section and matrix together) and then to unscrew the screws and screw them back in order to fix the special piece or joint; all this is eliminated, since the keys are already stamped into the deformed edges of the sections.

The pre-forming of the key deformations at a constant interval along the whole length of the edges of the sections, during the forming process, broadens the application of the plug and matrix locking system to include very thick sections, which may be used for stronger structures.

The system of assembling the forgings is considerably simplified, which also reduces costs, since the forgings may be made lighter; in this way the applications of the system may be broadened. Many types of composite section may be made, with almost infinite shapes and dimensions. The assembly of the elementary sections to form a composite section may also be carried out—independently or simultaneously—with stiffening cross brackets (according to the said earlier patent) or with lighter forgings or stampings as illustrated below, or with components formed from sheet metal.

BRIEF DESCRIPTION OF THE DRAWINGS

The invention will be more clearly understood from the description and the attached drawing, which shows a non-restrictive practical embodiment of the invention. In the drawing.

DETAILED DESCRIPTION OF THE INVENTION

According to the illustrations in the attached drawing, and with particular reference initially to FIGS. 1 to 5, 36 to 39 and 51 and 52, elementary sections designed for the formation of cold-formed composite sections, and indicated with the reference numbers (odd numbers) 11 to 23 in the various configurations of the said elementary sections, all have longitudinal edges that are indicated by the number 25 in all cases., which by the combination of two or more elementary sections are made to face each other with a limited space between them, to form longitudinal slots indicated as a whole by 27; the opposing edges 25 forming each slot converge inwardly. Characteristically, according to the invention, these edges 25 already have, as a result of the manufacturing process (during production in the factory), a series of deformations 25A which essentially form a continuous and uniform corrugation of the terminal borders of the said edges, with impressions 25A which correspond to the impressions made on a one-off basis in assembly by means of a matrix and plug according to the preceding solutions and as mentioned in the introduction to the present description. These impressions 25A, which form the said corrugations, are made approximately along the whole extension of each of the edges 25 and with a constant interval between one impression and the next. In practice, the working of the edges 25 with the impressions 25A in order to form the said corrugation takes place during the working of the sheet metal for the formation of the various elementary sections such as those indicated by the numbers 11 to 23, and others. The impressions 25A are therefore made without incurring any significant costs in addition to those incurred for formation of the elementary sections themselves.

Figure 7:
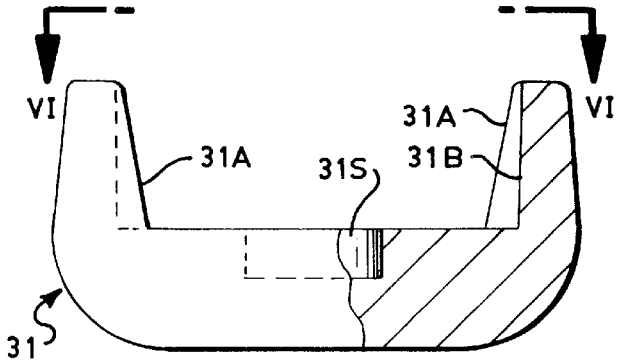
FIGS. 6, 7 and 8 show a receiving plate or matrix in a view along the line VI—VI in FIG. 7, in a view and partial section through VII—VII in FIG. 6, and in a view through VIII—VIII in FIG. 7.
Figure 8:
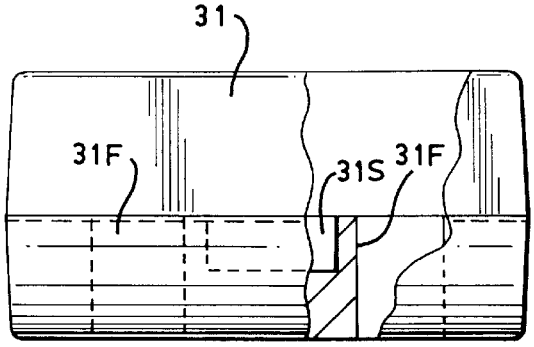
Figure 6:
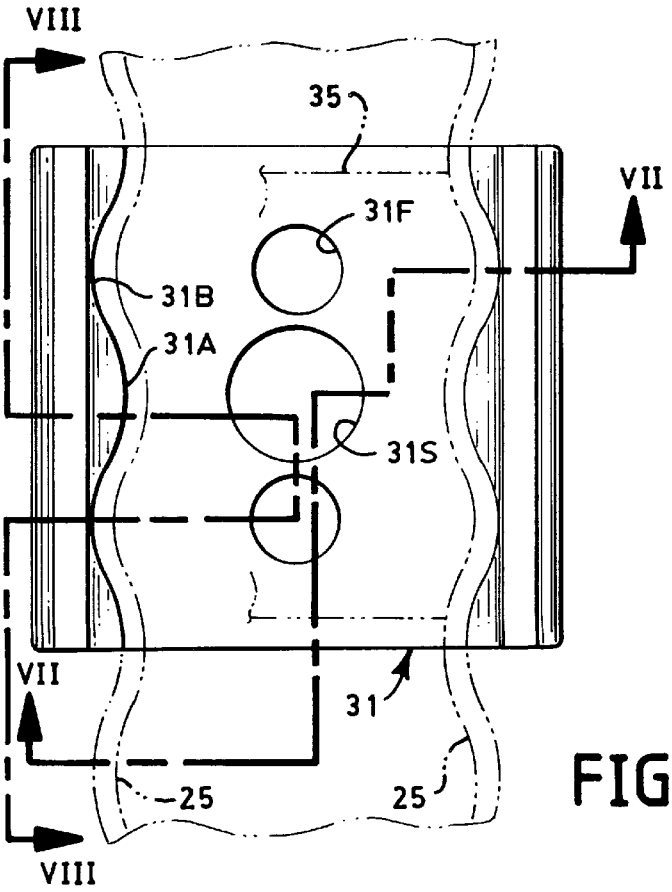
Figure 10:
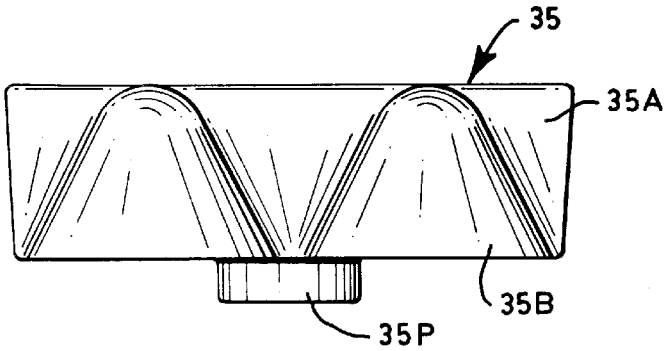
FIGS. 9, 10, 11 and 12 show in various views and sections a locking plate or plug designed to engage with the receiving plate shown in FIGS. 6, 7 and 8.
Figure 9:
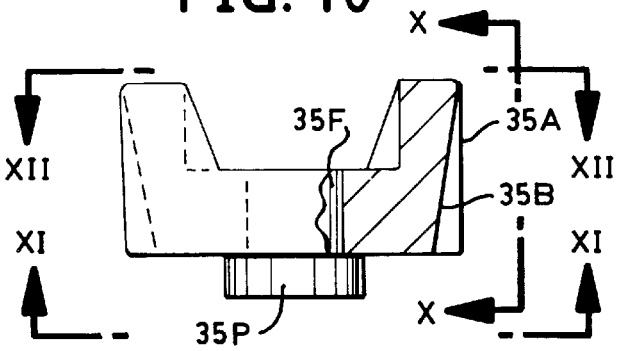
Figure 11:
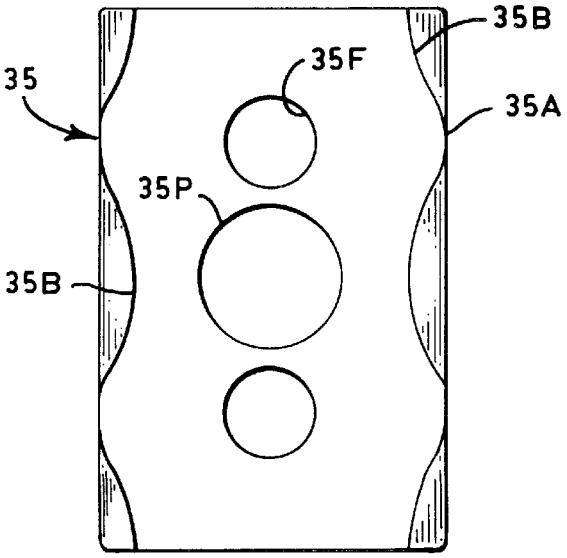
Figure 12:
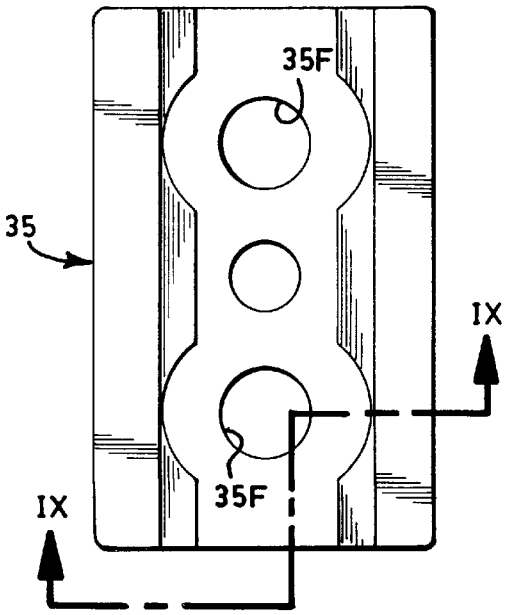
Figure 13:
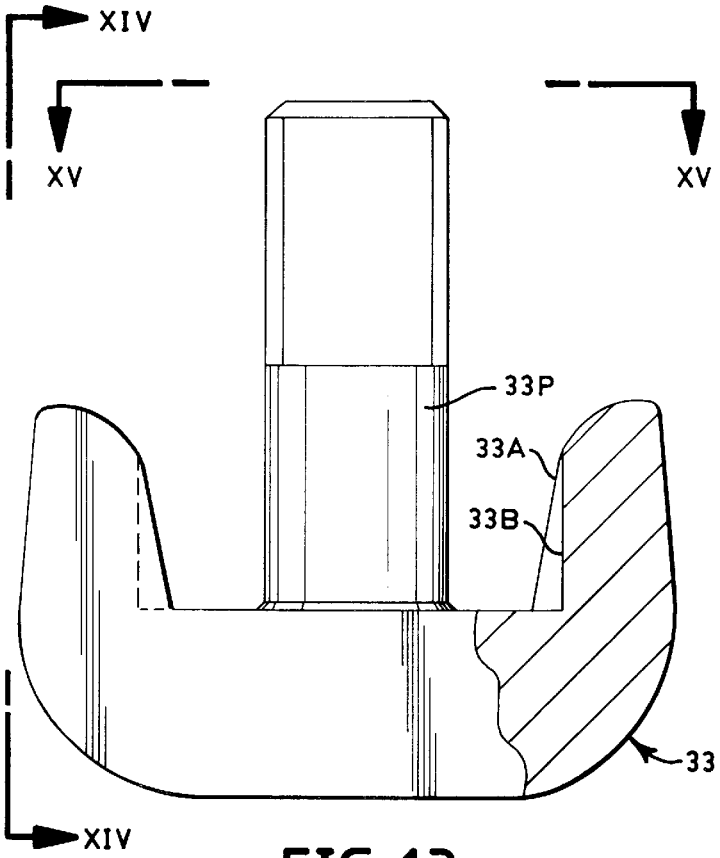
FIGS. 13 to 15 show an anchor-shaped receiving plate with a threaded pin, in various views and partial sections.
Figure 14:
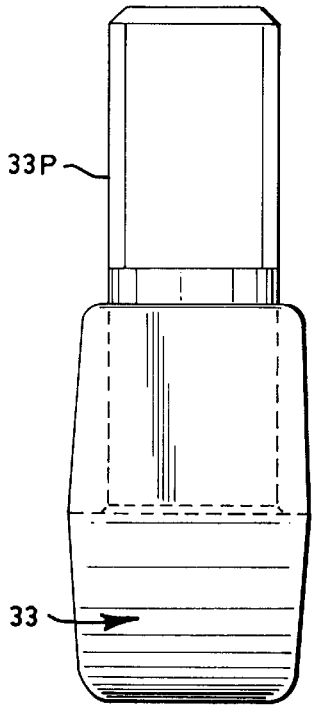
Figure 15:
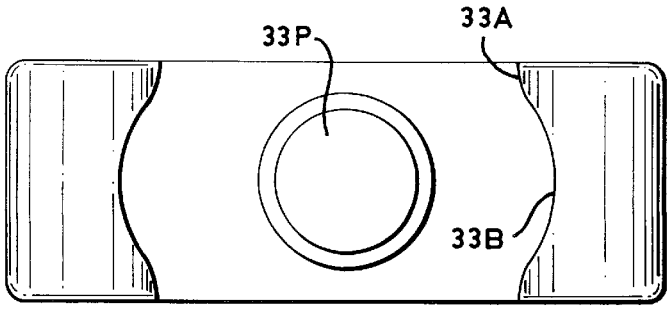
Figure 16:
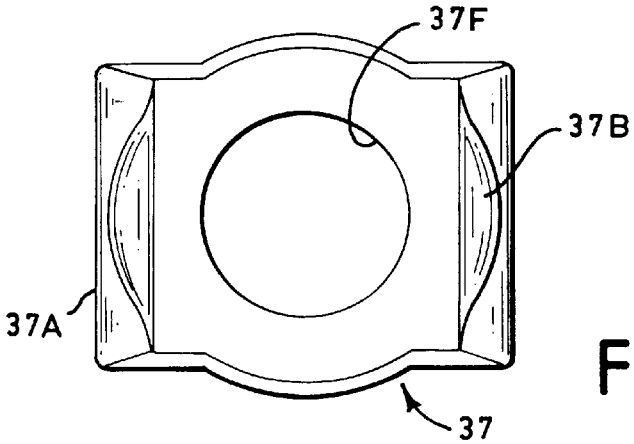
FIGS. 16 to 19 show a locking plate or plug designed to engage with the anchor shown in FIGS. 13 to 15.
Figure 18:
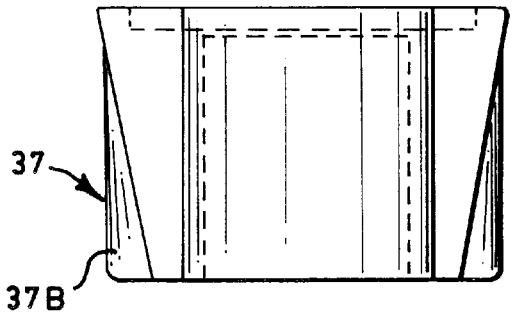
Figure 17:
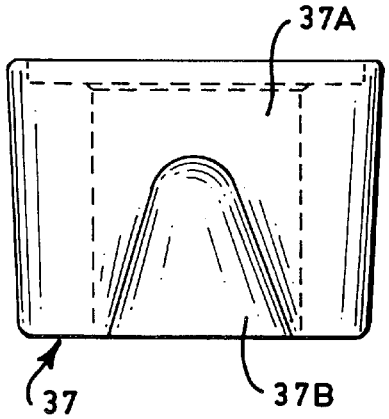
Figure 19:
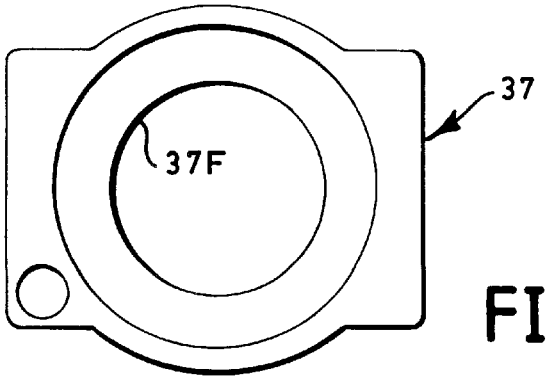
Figure 20:
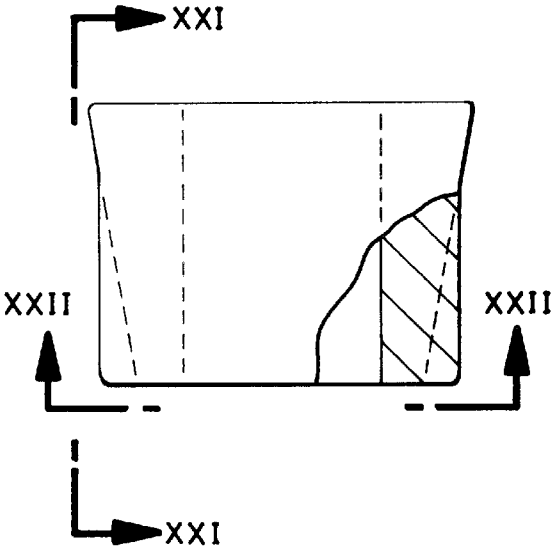
FIGS. 20 to 22 and 23 to 25 show—in various views and partial sections—components similar to those illustrated in FIGS. 6 to 12, but designed to obviate the use of stiffening cross brackets.
Figure 21:
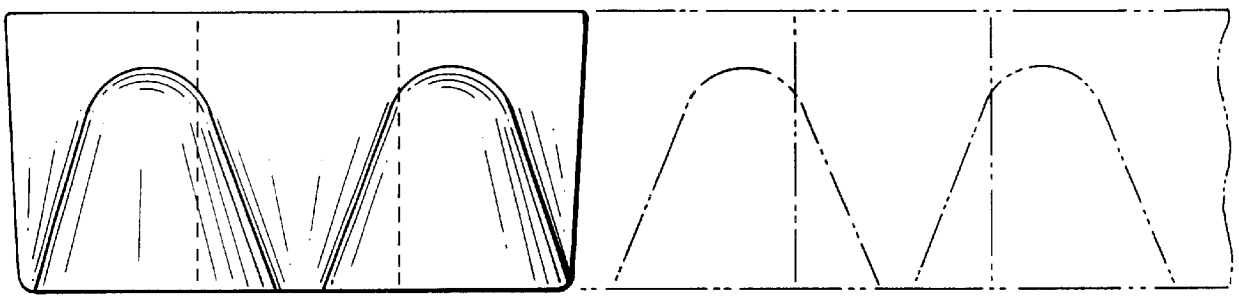
Figure 22:
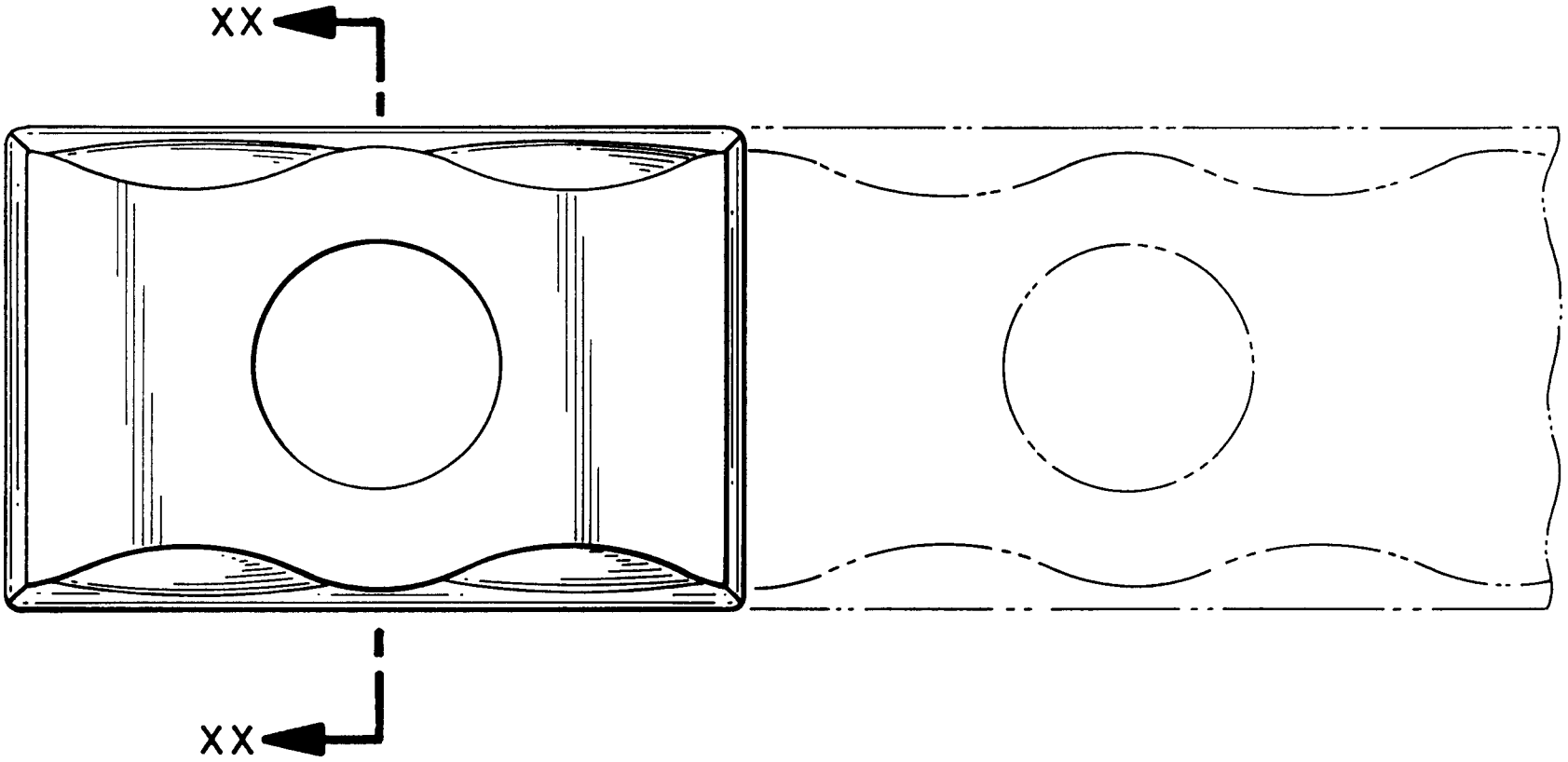

The preformed impressions 25A of the edges 25 match—in shape and in their spacing from each other—the profiles of the receiving matrices or plates, such as the profiles 31B formed in the opposite walls 31A of the receiving plates or matrices 31 shown in FIGS. 6 to 8, or the profiles 33B of the walls 33A of the receiving plates or anchors or matrices 33 shown in FIGS. 13 and 15; the corrugations also match the impressions of the locking plugs or plates such as 35 in FIGS. 9 to 12 or 37 in FIGS. 16 to 19, whose lateral walls 35A and 37A respectively are inclined in the same way as the walls 33A and have projections 35B and 37B which match the depressions 31B and 33B respectively. As mentioned previously, the intervals, the depths and the radii of curvature of the corrugations are proportional to the thickness of the sections, and therefore the forgings will have dimensions, intervals, depths and radii of curvature to receive the corrugated sheets according to the thickness of the sections.

It follows from the above description that the connection between the receiving matrices or plates such as 31 and 33 and the corresponding locking plugs or plates such as 35 and 37 is made by placing them in any position along the longitudinal slots 27 formed by the positioning of the elementary sections with respect to each other, without the need for a one-off deformation to be carried out by clamping between the matrix and the plug as specified in the preceding solutions cited above. The operation of locking between elementary sections by means of the receiving plates or matrices such as 31 and 33 or equivalent elements and locking plates or plugs such as 35 and 37 therefore takes place without the need for significant forcing to produce the impressions in the edges, since the impressions have already been formed by the manufacturing process daring the formation of the elementary sections and match each other in the facing edges 15 of each slot 27. This provides all the advantages already indicated above, and in particular makes it possible to increase the thicknesses of the elementary sections, the deformation of whose edges is carried out by the production equipment and not by the equipment to be used on a one-off basis during assembly.

The ligited size of the interval between the impressions such as 25A allows for all the requirements of positioning which may be needed for the assembly of various structures and which may be obtained with the sections in question, both for connection between the various elementary sections and for the formation of fixings and the positioning of special components to meet the requirements of formation of the various structures.

Figure 3:
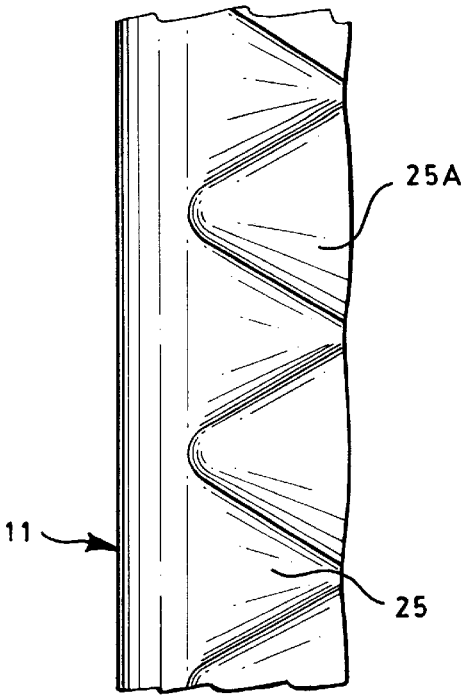
FIGS. 1, 2 and 3 show a portion of an elementary section for the formation of the sections according to the invention, in a view through I—I in FIG. 3, in a section through II—II in FIG. 1 and in a view through III—III in FIG. 1.
Figure 1:
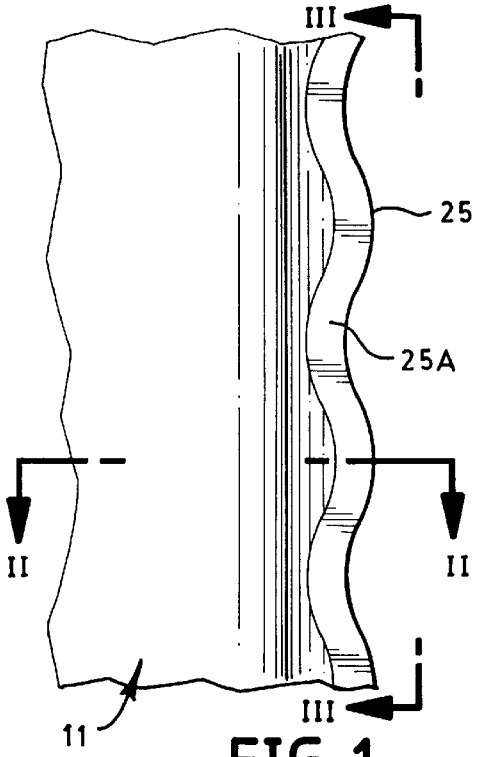
Figure 2:
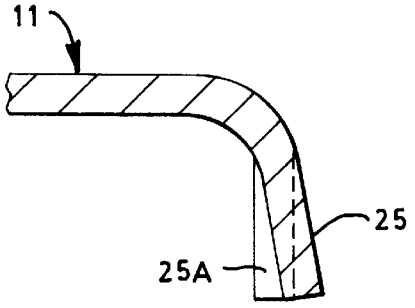
Figure 5:
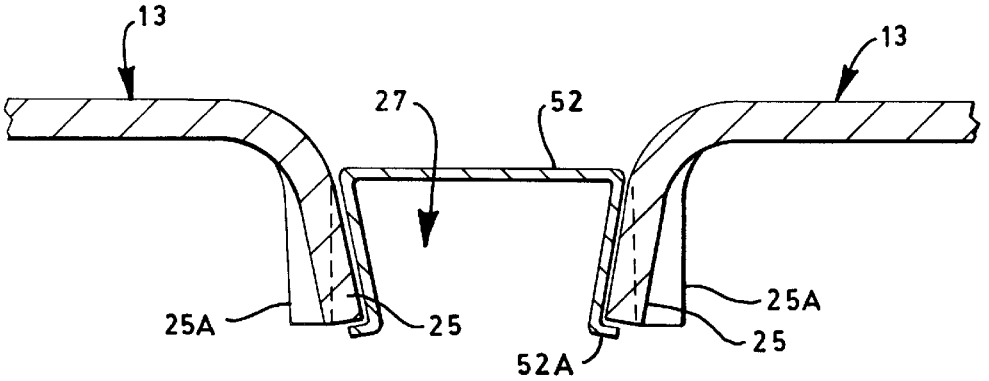
FIG. 5 shows two contiguous and facing portions of elementary sections according to the invention combined with a snap-on channel piece or flashing.
Figure 4:
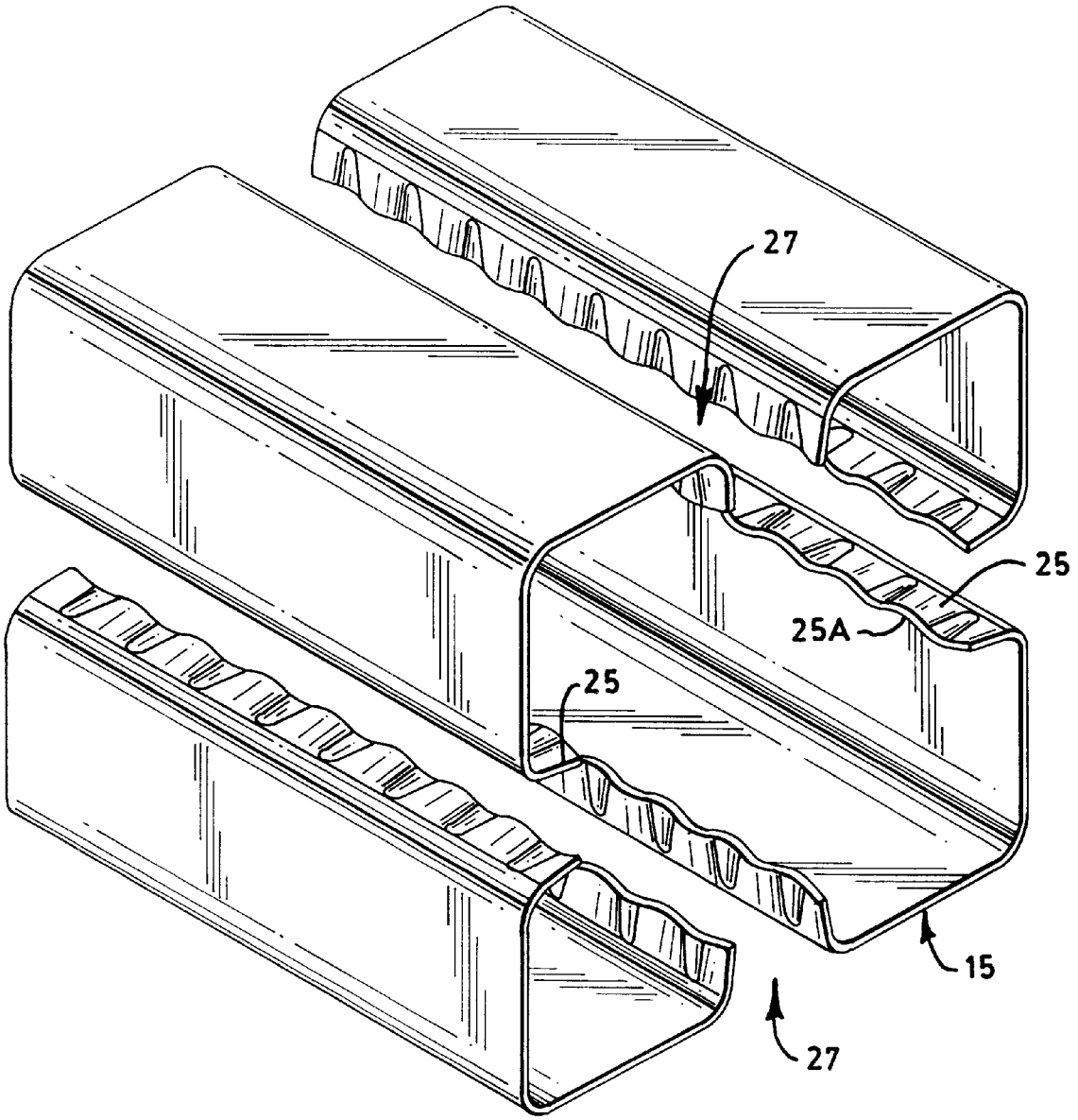
FIG. 4 is a perspective view of a portion of a composite section formed from a plurality of elementary sections.

FIG. 5 shows the use of a channel piece or flashing 52, which may be snapped onto cover the longitudinal slots 27; these channel pieces or flashings 52 may be made from sheet metal or from substantially elastic synthetic resins, so that the outwardly projecting terminal borders 52A of the said channel pieces or flashings 52 may be snapped through the narrowest areas of the slots 27 for a permanent snap fit with a position determined-by the said borders and by the converging sides of the U-shaped flashings to match the profile of the slots formed by the edges 25. The flashing may be used for two purposes:

a—to meet functional requirements, to cover those slots of the composite sections which have to face outwards because of assembly requirements;

b—to meet aesthetic and/or architectural requirements, according to which the flashings may have colours that contrast with the single or composite section, thus creating a profile (width of the channel piece) of a different colour from that of the centre of each single or composite section.

FIGS. 6 to 12 show a receiving plate or matrix and a locking plate or plug 31 and 35 respectively, which engage together and each of which has a plurality of corrugations in the walls 31A and in the lateral walls 35A. According to these figures, each of the two components has two through holes 31F and 35F respectively for the bolts or other means of connection and locking. One of the two components 31 and 35, for example 31, has a socket 31S and the other has a pin, for example 35P. In addition to permitting rapid and secure positioning through the reduced space of the longitudinal slots 27, to which the pairs of components 31 and 35 are applied transversely, the fundamental object of the receiving plate shown in FIGS. 6 to 8 and the locking plate shown in FIGS. 9 to 12 is to secure the assembly of the elementary sections in place of stiffening cross brackets; their principal task is therefore to hold the elementary sections together and at the same time to prevent the elements of the composite section sliding with respect to each other, when the section is subjected to stresses in this direction. This is possible as a result of the continuous preformed corrugations on the edges of the individual sections, which enable the geometry of the two components (matrix and plug) to be modified, so that the whole assembly becomes considerably lighter. Provision of the pin 35P, which is inserted into the blind hole 31S, also makes it possible to reduce the size of the steel bolts or rivets to be inserted in the holes 31F and 3SF; the pin essentially has the function of withstanding the shear stresses produced by the stress tending to make the elementary sections slide, while the bolts or rivets are not subject to shear stresses and have the sole function of holding the two elements clamped together with a minimum of force. The reduced height of the locking plate 35 enables the slot to be covered with the channel piece or flashing 52, FIG. 5, even when the said plate 35 is present.

The components 33 and 37 shown in FIGS. 13 to 19 have, respectively, a captive pin 33P which is threaded and a hole 37F to receive the said pin 33P. At least one nut is screwed on the pin 33P to form the connection between the two components 33, 37, or for the additional application of external components to be connected to the complex section which can be made with these components.

The components illustrated in FIGS. 20 to 25 are basically similar in terms of function to those illustrated in FIGS. 7 to 12 but are for different applications, as stated previously.

It should be noted that components such as those shown in FIGS. 20 to 25 may be formed with a different number of impressions and therefore with a different length, according to the requirements of the structural joint to be formed.

Figure 24:
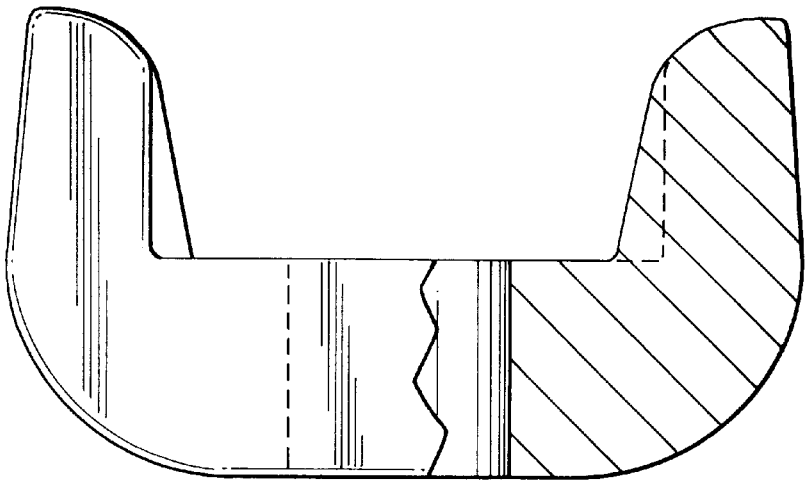
Figure 23:
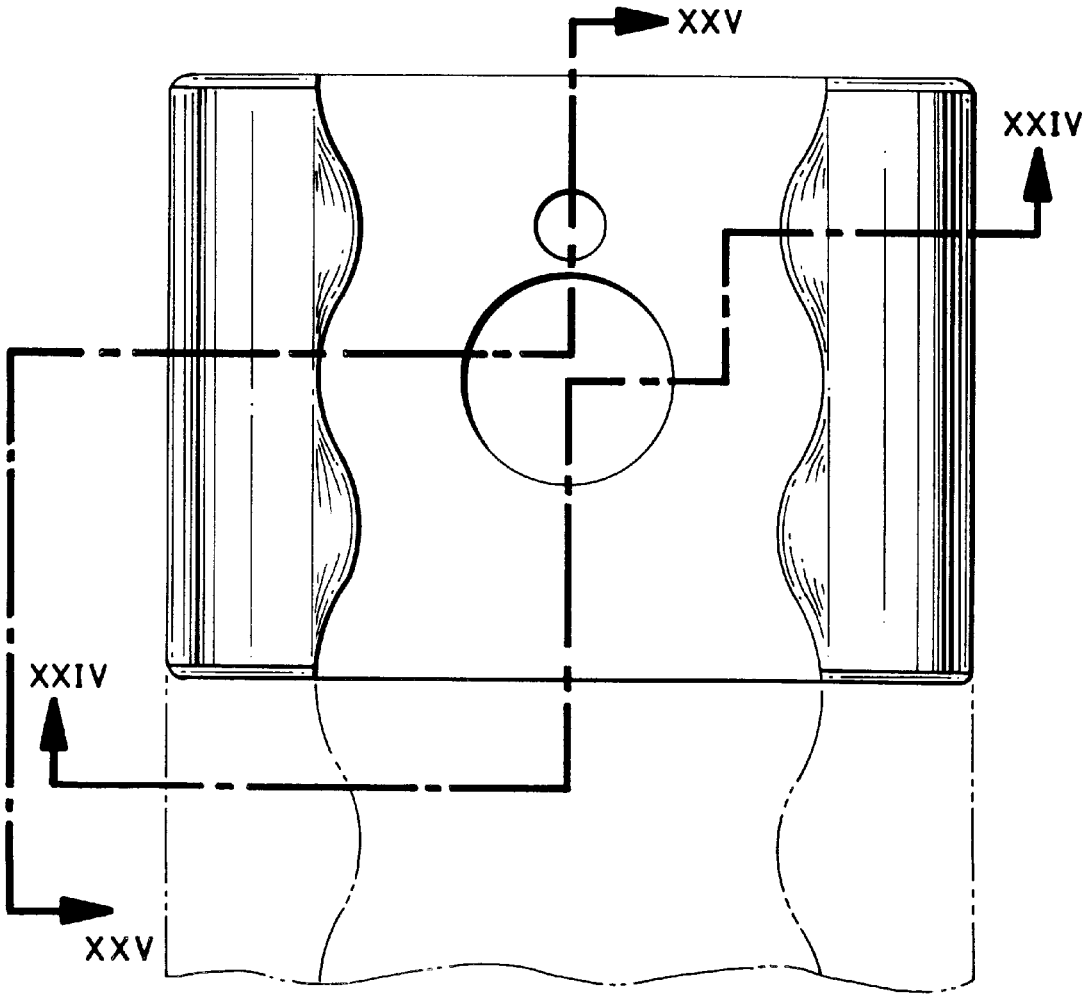
Figure 25:
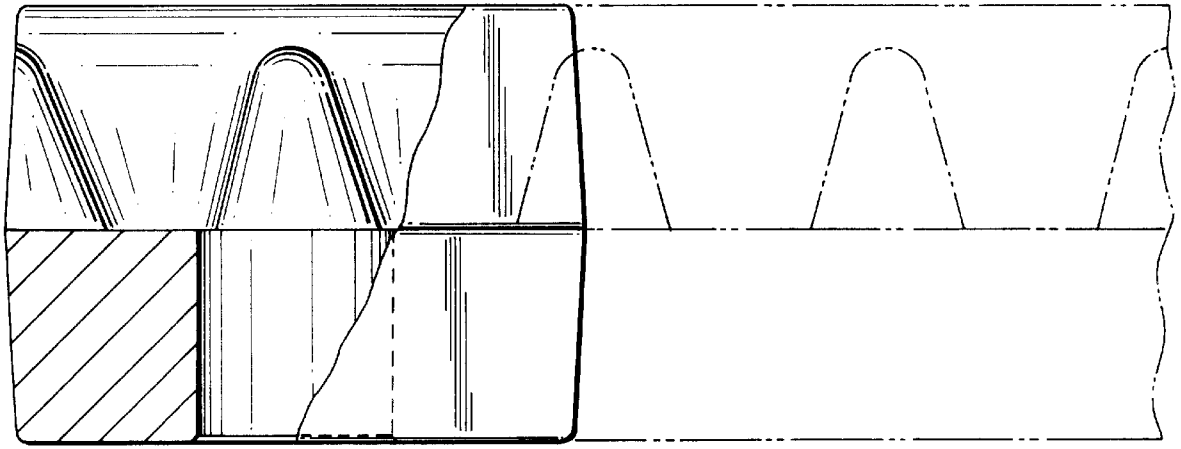
Figure 26:
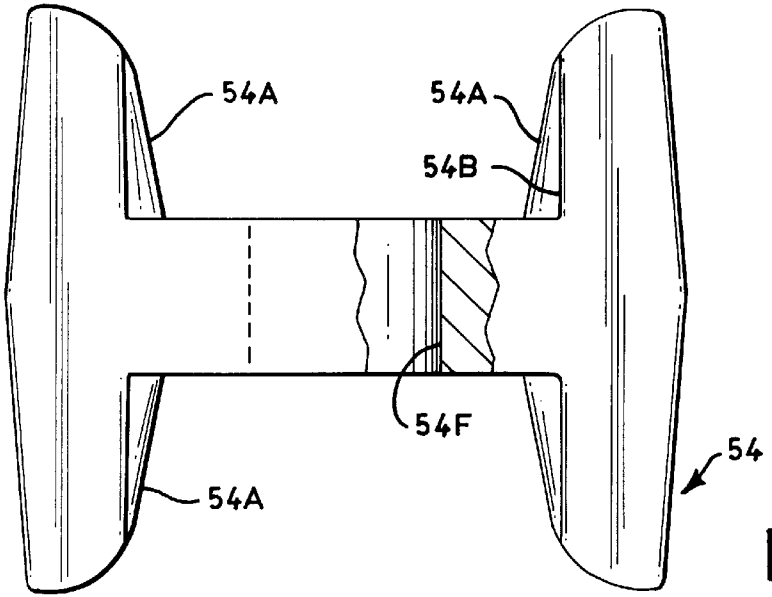
FIGS. 26 to 28 show a double receiving plate or matrix, in various views and sections.
Figure 27:
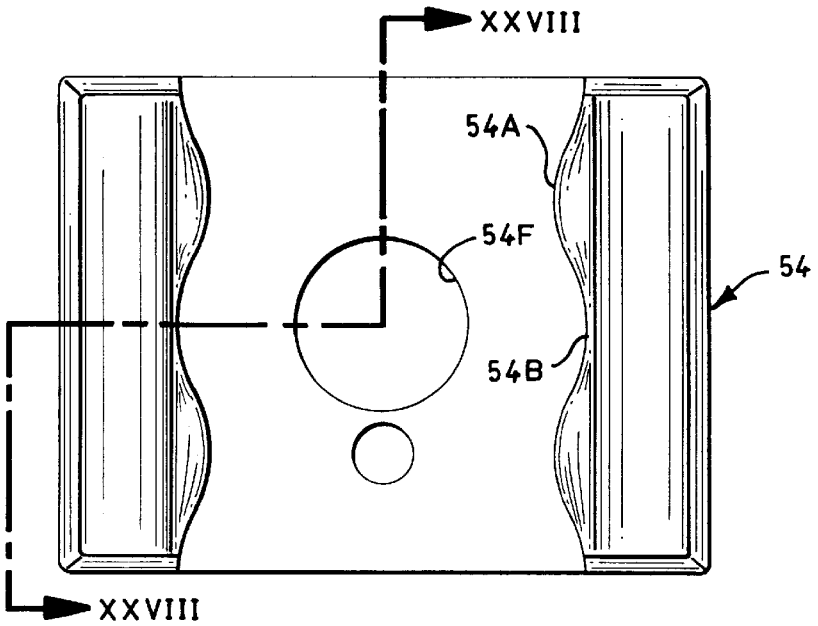
Figure 28:
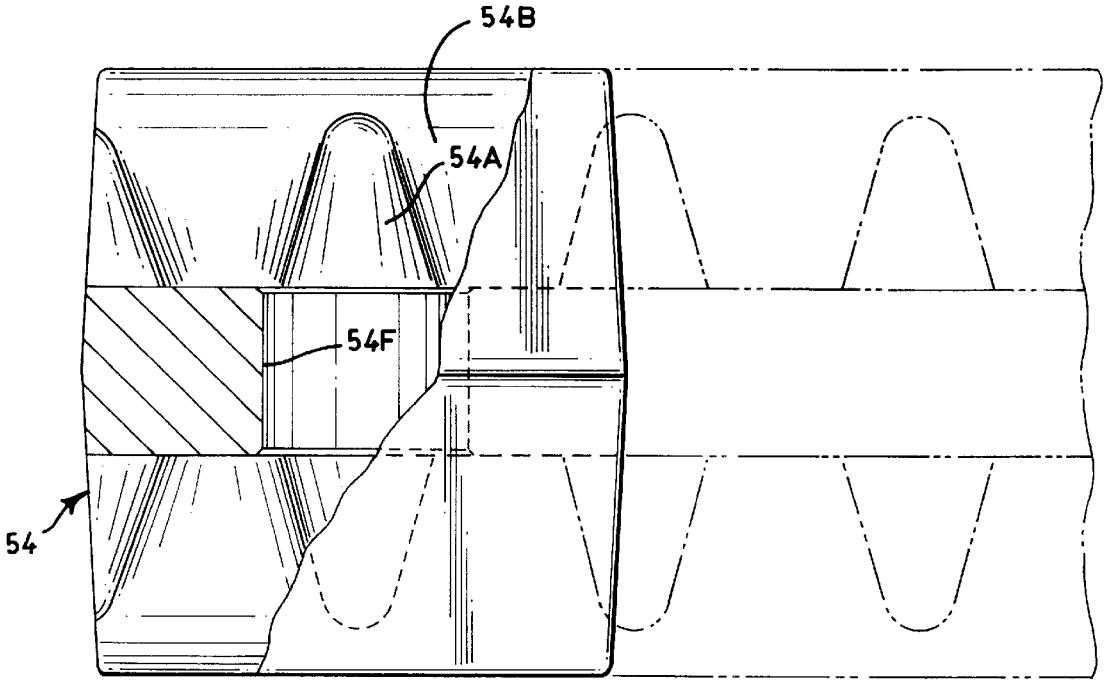

FIGS. 26 to 28 show a double receiving plate or matrix 54, in other words one which has two opposing channels delimited by inclined walls 54A forming impressions 54B, in a similar way to what has been described, for example, with reference to the plates shown in FIGS. 23 to 25. The reference 54F indicates through holes for connecting and locking bolts.

FIGS. 29 to 33 show components in the form of a double receiving plate 56, similar to those described previously and capable of connecting C-shaped elementary sections indicated by the reference 58 and with a configuration which also permits the formation of 90° connections between intersecting composite sections. The connection is made with the aid of brackets 60 having a connecting plug or plate 60A on each of the arms of the bracket 60 for connection to the components 56 and to additional plug components 62 similar to the components 35 but with an extended length, so that they can connect the sections 58X which are spaced apart from each other but in alignment. It is worthwhile noting that only one side 60A of the bracket 60, which acts as a plug, will have the corrugated impressions or keys that are inserted into the section 58, while the side 60B will be flat, without corrugations or keys. This is done for two reasons: (1) to facilitate assembly; (2) because the corrugations or keys would be useless, since they would not operate in the longitudinal direction of the sections 58Y and 58Z, and therefore the connection in this case will be entirely dependent on the bolt, which will be designed with suitable dimensions. This joint can be used, in particular, in scaffolding for interior decoration.

Figure 29:
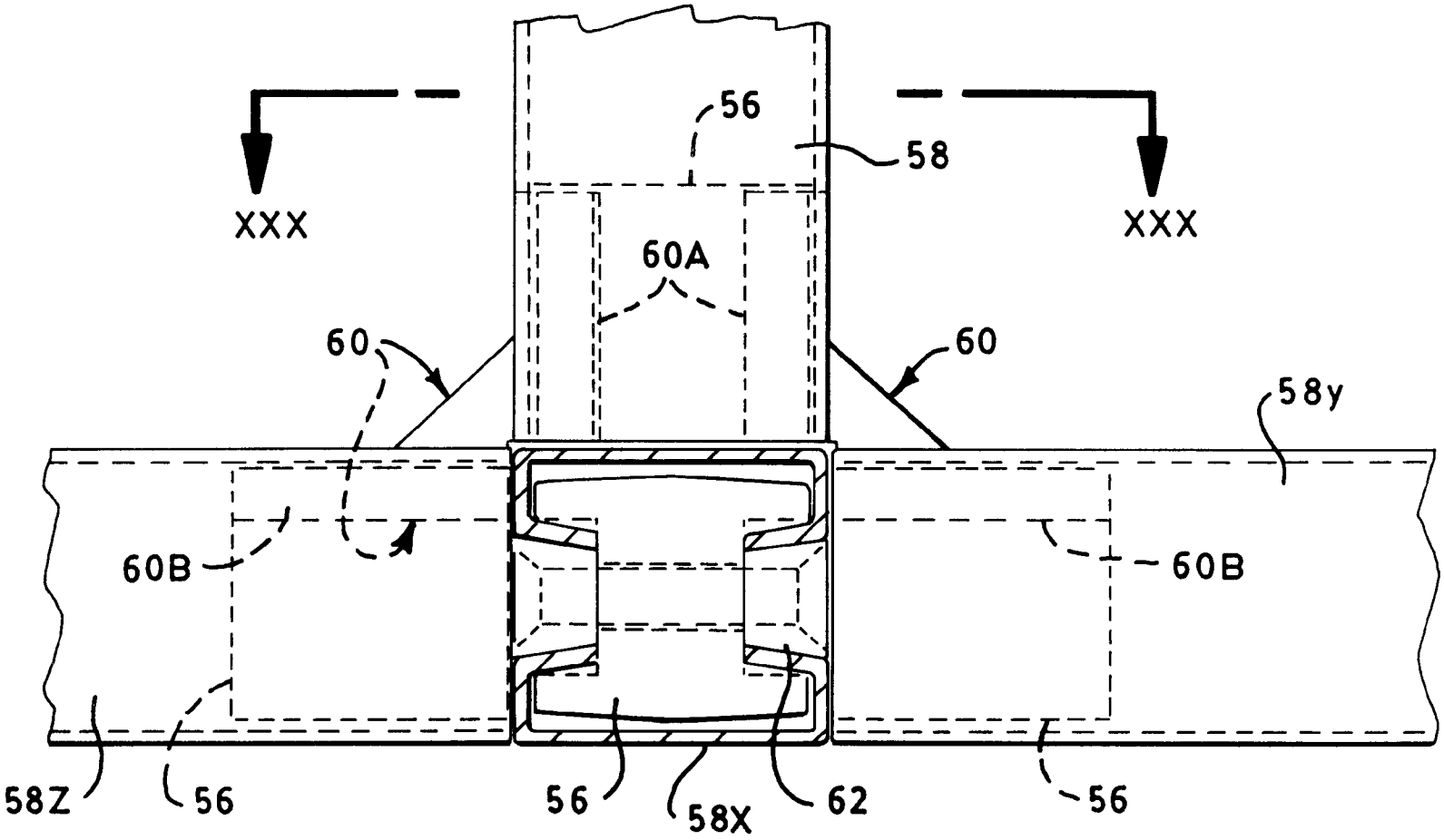
FIGS. 29 and 30 show in two views and sections an intersection joint between multiple intersecting sections.
Figure 30:
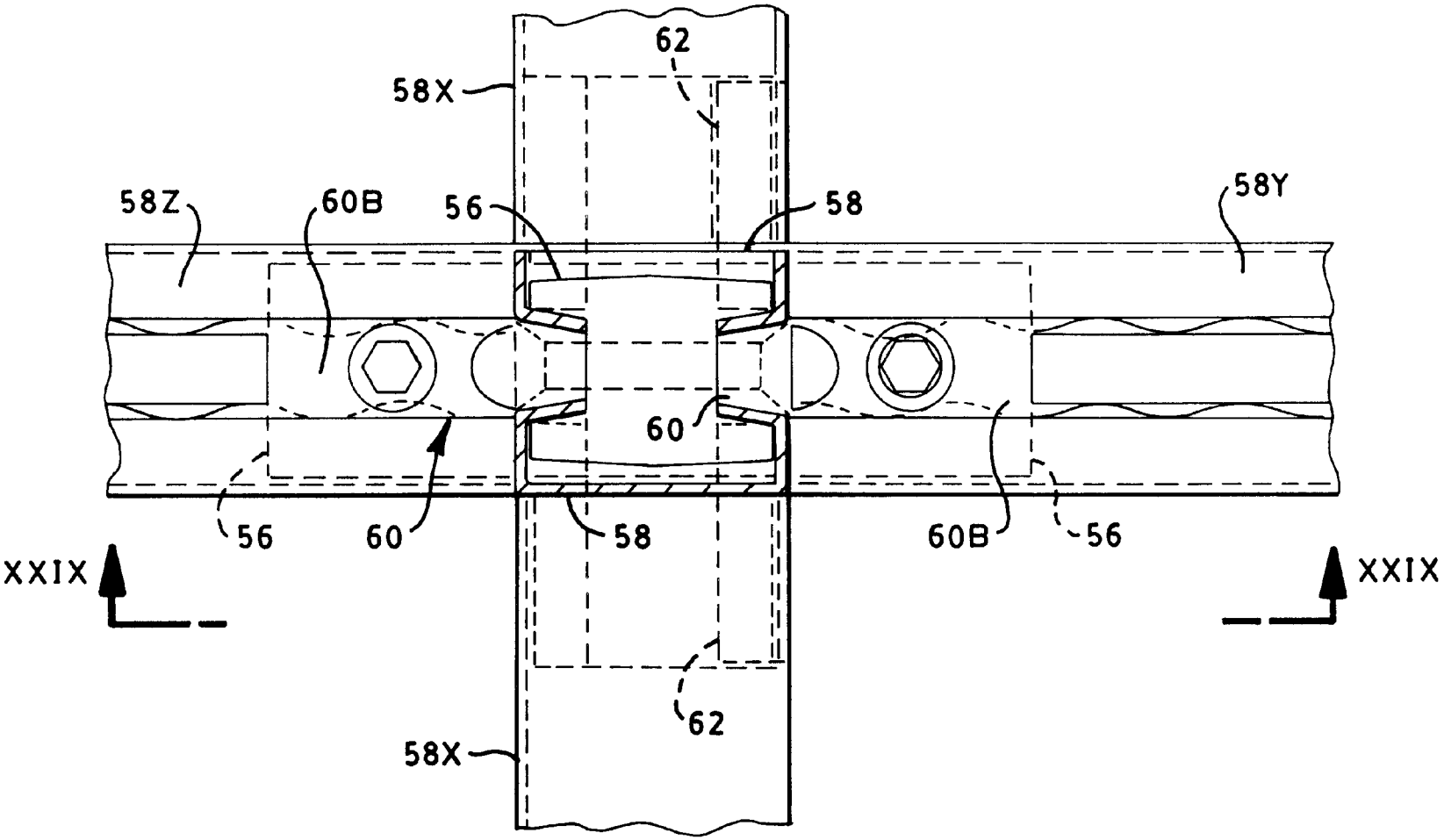
Figure 31:
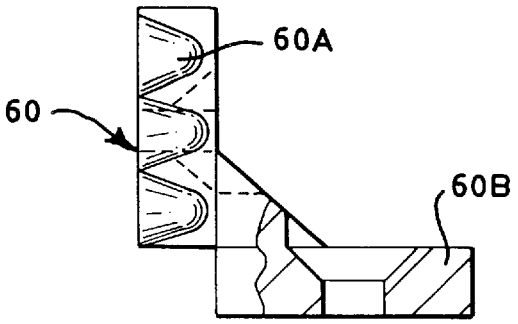
FIGS. 31 and 32 show a plug bracket, in other words a locking bracket, for the formation of the joint shown in FIGS. 29 and 30.
Figure 32:
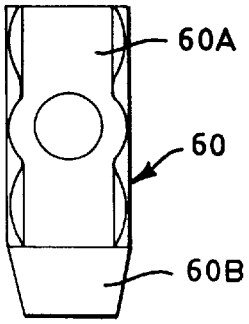
Figure 34:
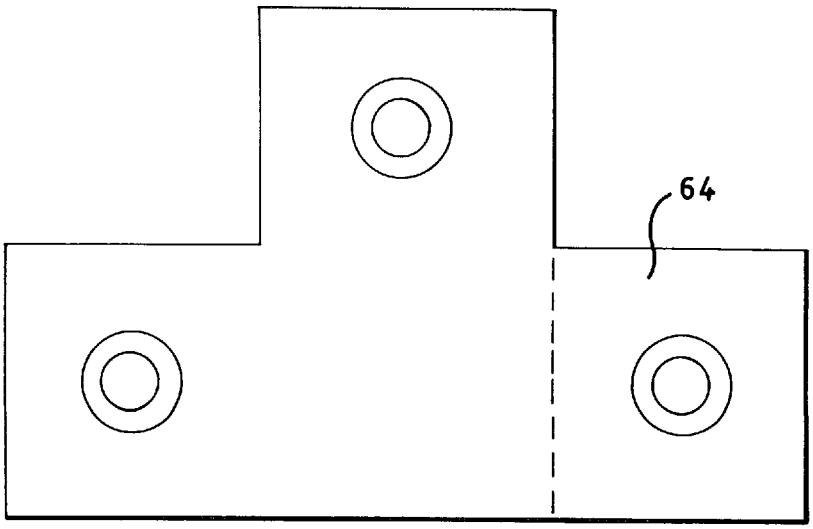
FIG. 34 shows a T-shaped plate designed for purposes which may include finishing.
Figure 35:
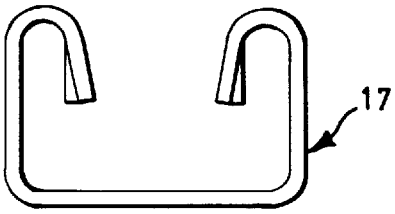
FIGS. 35 to 39 show elementary sections of various types.

FIG. 34 shows a T-shaped plate 64 with holes, which is used to complete the connections in the joints illustrated in FIGS. 29 and 30; the application of the plate 64 essentially has the function of covering the end of the connection between the sections 58X and 58 when the section 58Y and 58Z is absent.

Figure 38:
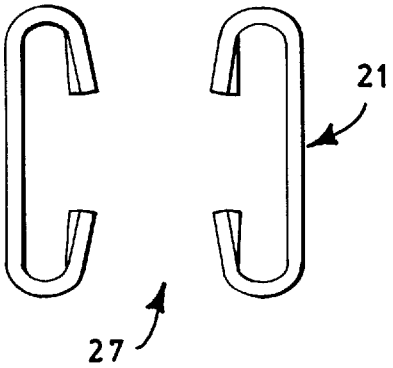
Figure 36:
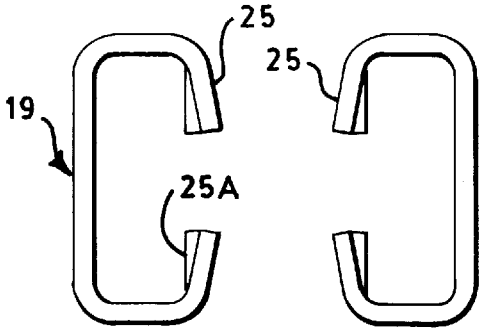
Figure 39:
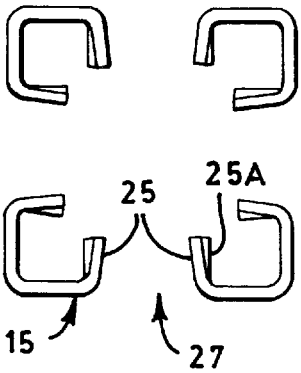
Figure 37:
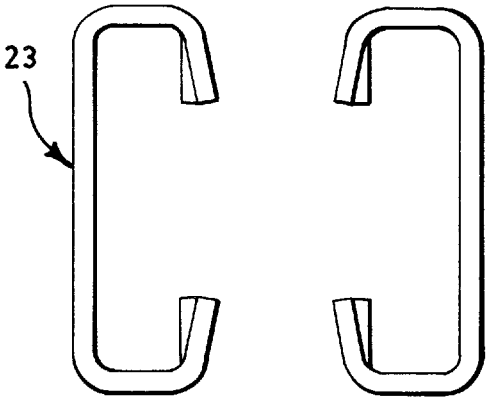

FIGS. 35 to 39 show elementary sections which are also combined with each other. Apart from the difference in scale, the sections 17 in FIG. 35 and the sections 19, 23 and 27 in FIGS. 36, 37 and 38 have small dimensions, for light applications, but have shapes identical to those of the larger sections as indicated in the said earlier patent. The combination, in other words the assembly, of the elementary sections shown in FIGS. 36 and 38 is carried out using the double matrices as shown for example in FIGS. 26, 28, 33, 49 and 5. The section shown in FIG. 39 is preferably employed in medium-heavy structures.

Figure 40:
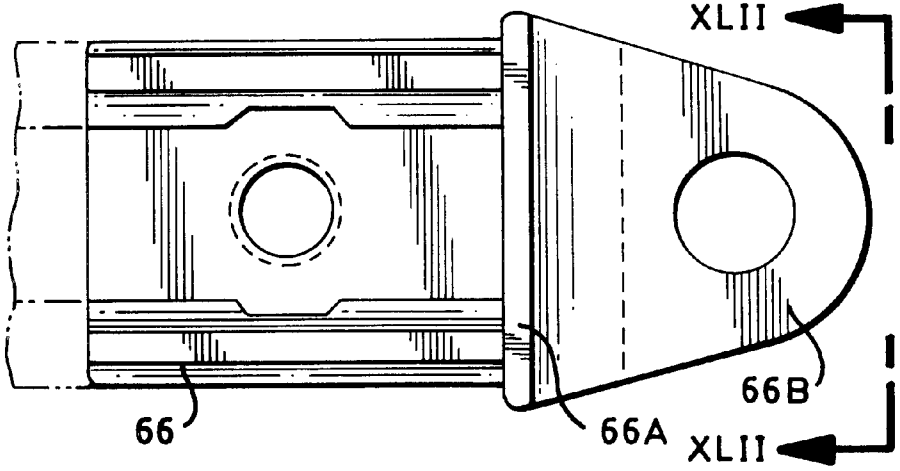
FIGS. 40 to 42 show a receiving plate or matrix with terminal fixing lugs, in various views.
Figure 41:
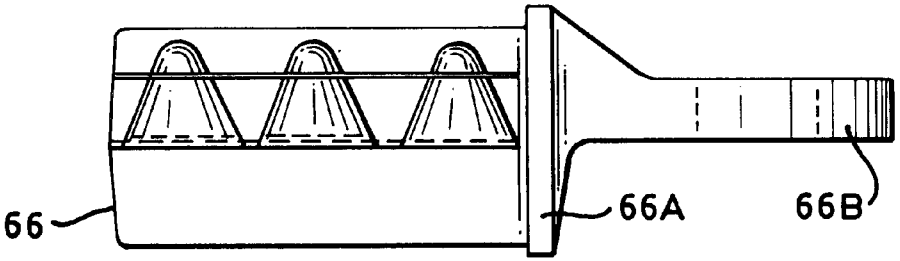
Figure 42:
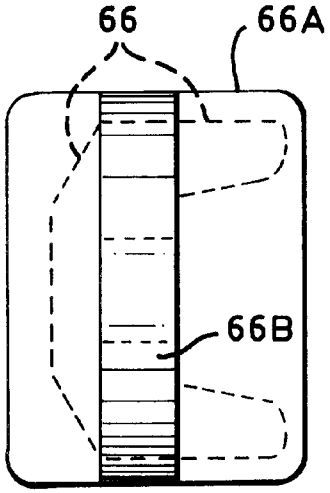
Figure 45:
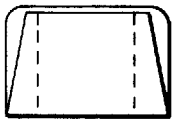
FIGS. 43 to 45 show a locking plug or plate in various views, suitable for use with the component shown in FIGS. 40 to 42.
Figure 43:
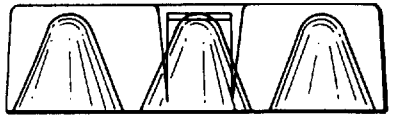
Figure 44:
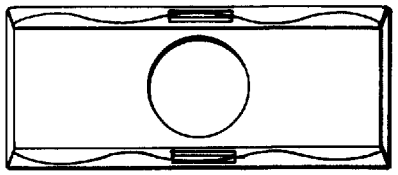

FIGS. 40 to 42 show a component in the form of a receiving matrix or plate 66 which has a plate 66A with a perforated lug 66B at its end for the application of other components and accessories. A locking plate or plug, as illustrated in FIGS. 43 to 45, or other equivalent device, may engage with this receiving matrix or plate 66.

Figure 33:
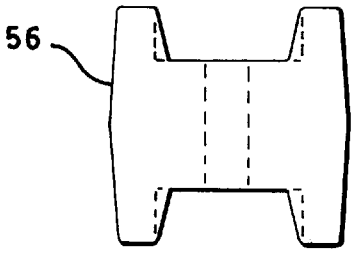
FIG. 33 shows a component with a double matrix or double receiving plate in the solution shown in FIGS. 29 and 30.
Figure 47:
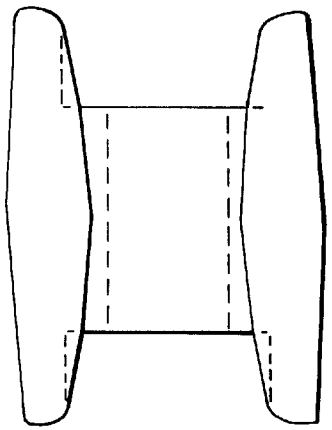
FIGS. 46, 47 and 48 show another lighter embodiment of a double receiving plate or matrix.
Figure 46:
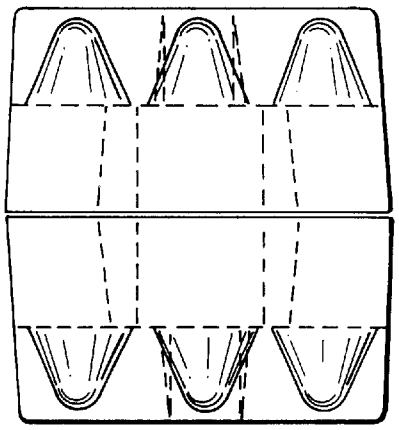
Figure 48:
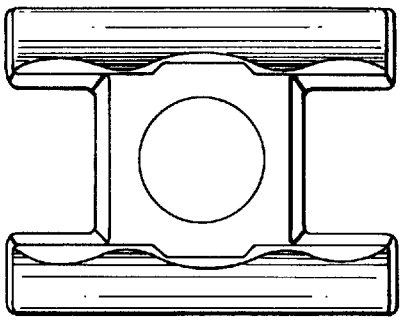

FIGS. 46 to 48 show a double receiving plate or matrix similar to that shown in FIG. 33 but shaped differently in order to reduce its weight.

Figure 49:
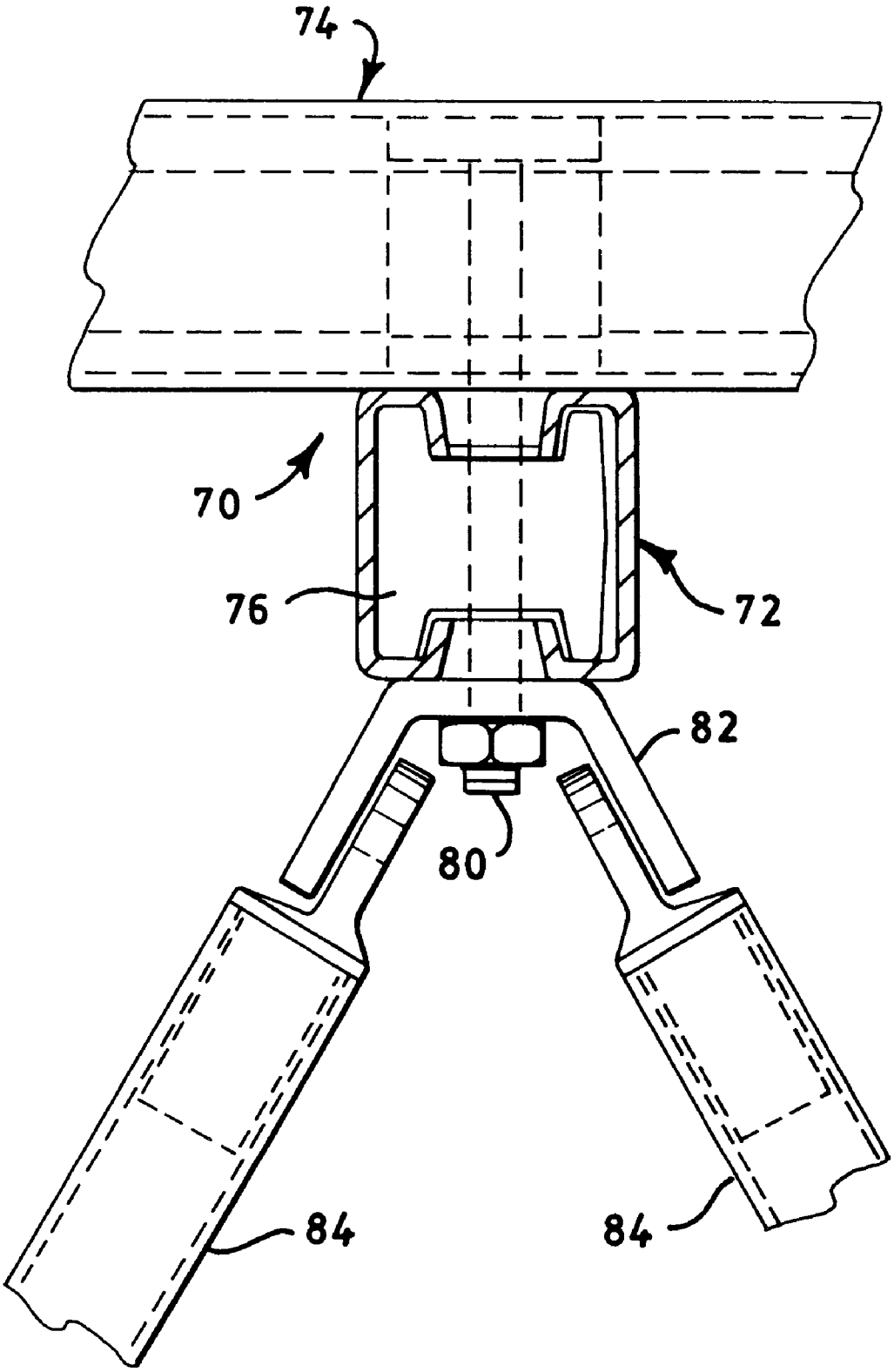
FIGS. 49 and 50 show a connecting joint for sections, comprising matrix members of the type shown in FIGS. 31 and 32 or of equivalent type, with external fixing members.
Figure 50:
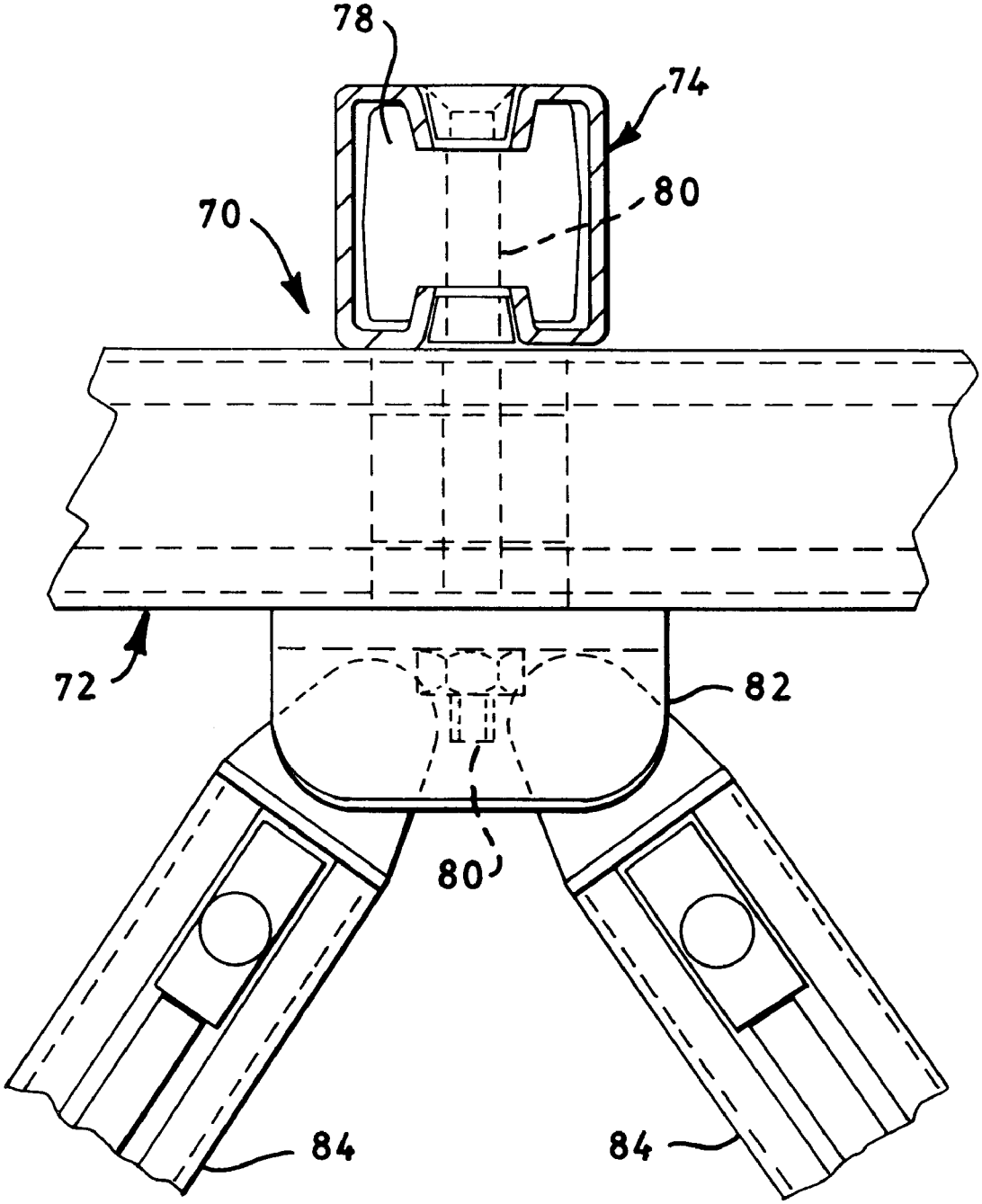

FIGS. 49 and 50 show a joint 70 which is formed for the connection of two sections intersecting at right angles and placed next to each other, indicated by the references 72 and 74. The connection is made with double receiving plate or matrix components 76 and 78 respectively, housed in the two composite sections 72 and 74 and connected to each other by means of a bolt 80 passing through them. A fastening 82 with two inclined lugs may also be connected with the same bolt 80, for example for the connection of braces or struts 84 or other equivalent components, which may also be formed from composite sections of the type described above.

Figure 51:
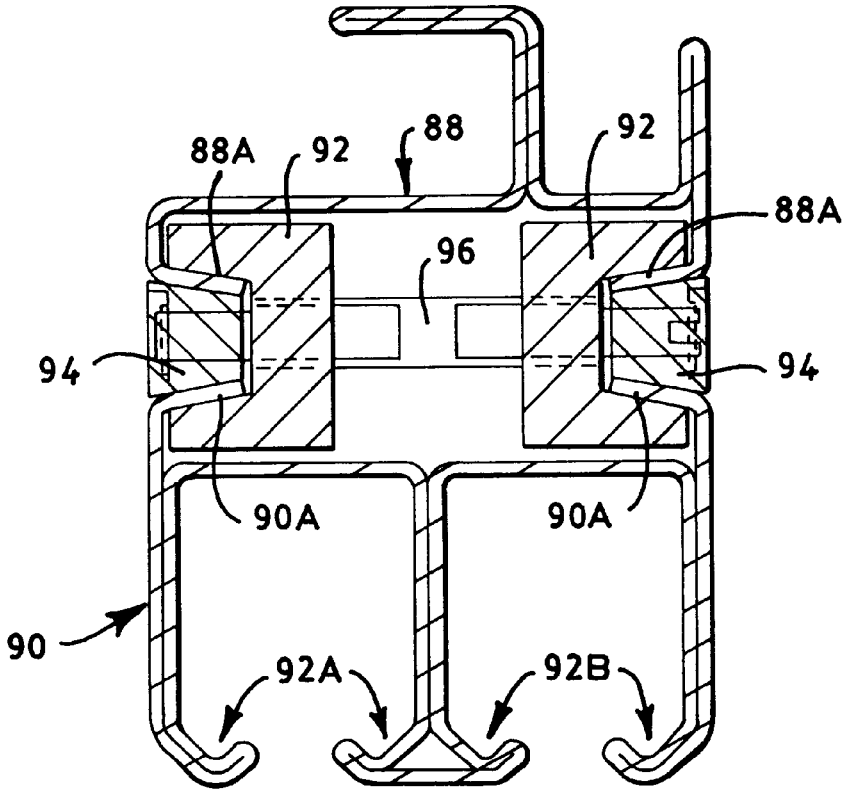
FIG. 51 shows in transverse section an embodiment with special sections to form sliding rails, applicable, for example, to lorry covers.

FIG. 51 shows an embodiment for the formation of sliding rails for trolleys and other equipment, also and in particular (but not exclusively) suitable for constructing sliding rails for lorries covered with sliding covers. In this embodiment, the reference 88 indicates a first section, shaped in a special way so as to form two inclined edges 88A facing each other in a symmetrical configuration. The reference 90 indicates a second section, which forms two pairs of guide channels or sliding or rolling rails 92A and 92B next to each other, for trolleys provided with coupled wheels; the said section 90 also has two inclined edges 90A facing each other in a symmetrical configuration. Two receiving matrices or plates 92 and two locking plugs or plates 94 engage with the two edges 88A and 90A positioned to form slots in the assembly, in a similar way to that described previously; as in the previous case, the edges 88A, 90A and the plates 92 and 94 have corrugated surfaces. The connection between the plates 92 and 94 may be made with common screws 96 which are turned by socket heads, with locking being provided by snap rings or equivalent elements.

Figure 52:
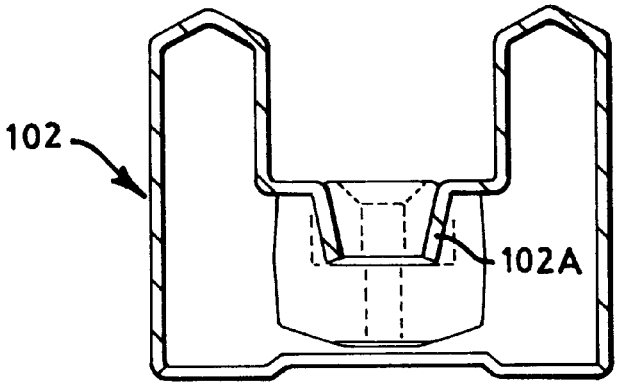
FIGS. 52 to 55 show special sections for door or window casings of external frames, sliding frames and hinged casings.

FIG. 52 shows a special section 102, for an external frame of a sliding casing. This section 102 has edges 102A for functions similar to those described previously, and is therefore capable of being combined with matrices and plugs, in other words with receiving plates and locking plates.

Figure 53:
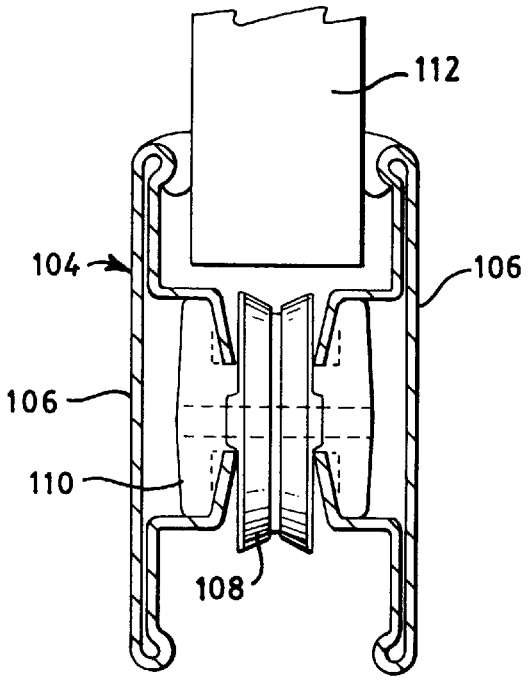

FIG. 53 shows a section for a sliding frame, indicated as a whole by 104 and formed from two elementary sections 106 positioned symmetrically with respect to wheels 108 which are disposed between the two sections 106. Double receiving matrices or plates 110 are used for the connection of the two elementary sections 106 and possibly also for the fitting of the wheels 108, while the reference 112 indicates a pane of glass or other sheet or panel which forms part of the sliding frame.

Figure 54:
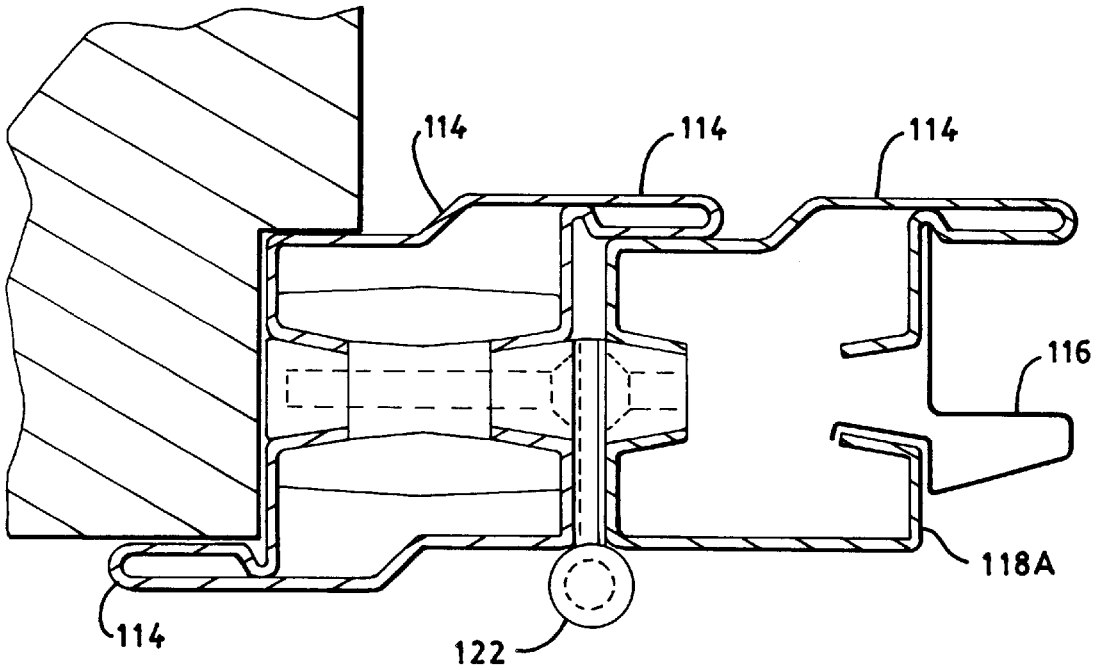
Figure 55:
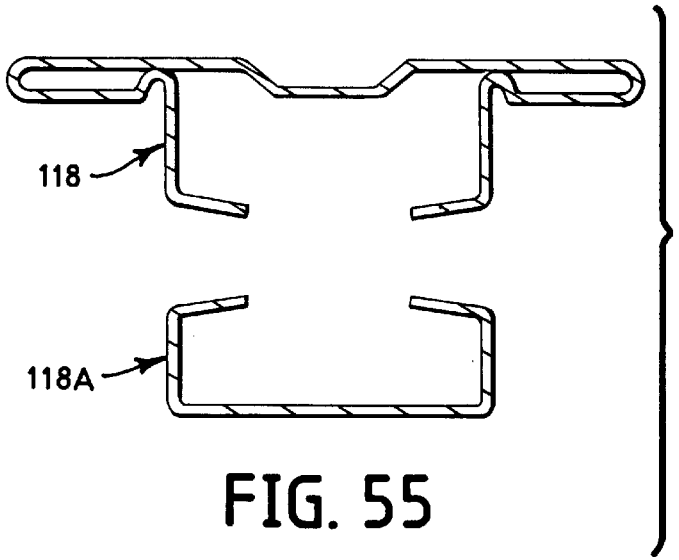

FIGS. 54 and 55 show solutions for hinged casings with composite sections such as those indicated by 114, 118 and 118A, for hinged casings to be combined with each other using double matrices or other connecting components of the type described previously. The reference 116 indicates a snap-on channel piece.

Figure 56:
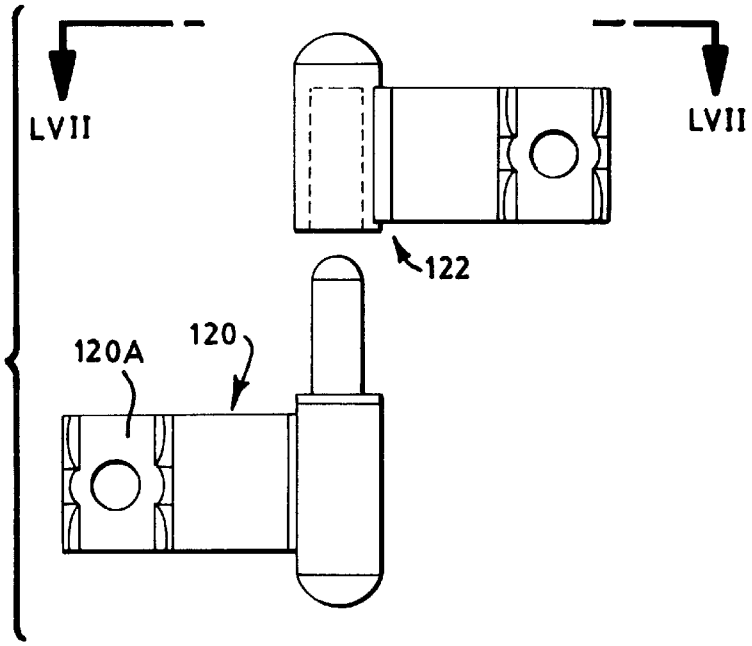
FIGS. 56 and 57 show two components of a hinge applicable to casings made with the sections shown in the preceding figures.
Figure 57:
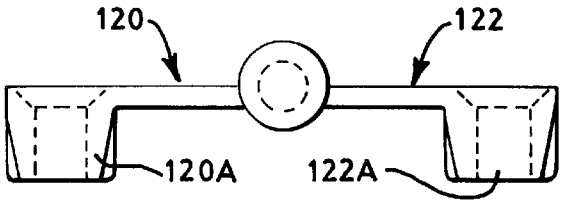

FIGS. 56 and 57 show the two components, male 120 and female 122, of a hinge whose components 120 and 122 can be connected to composite sections by means of supporting parts 120A and 122A having the shape of a locking plug or plate of the type indicated and described previously, and which is used for the application, in other words the fixing, of the hinge components.

Figure 58:
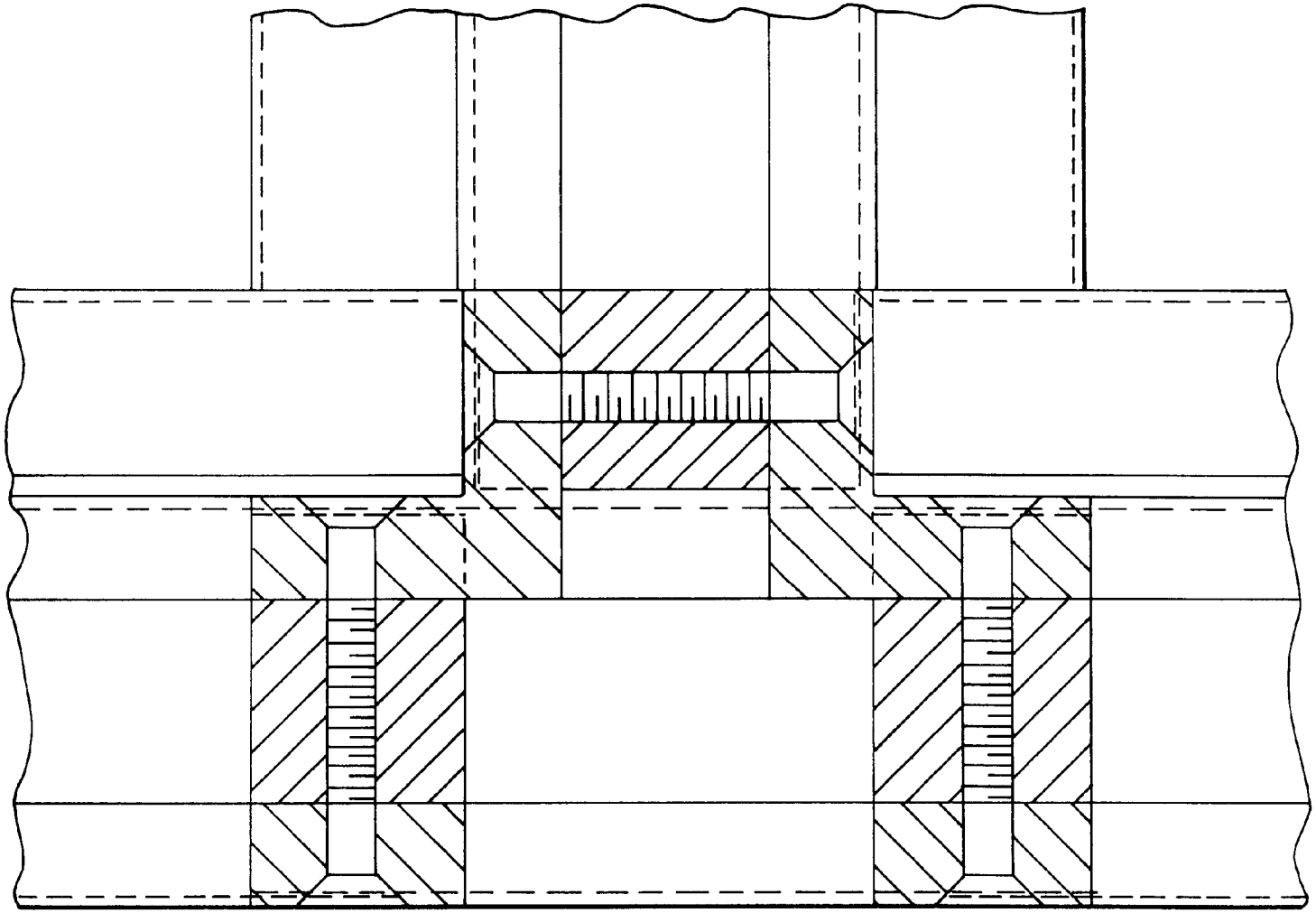
FIGS. 58 to 60 show possible examples of corner connections of sections for the formation of frames for door or window casings.
Figure 59:
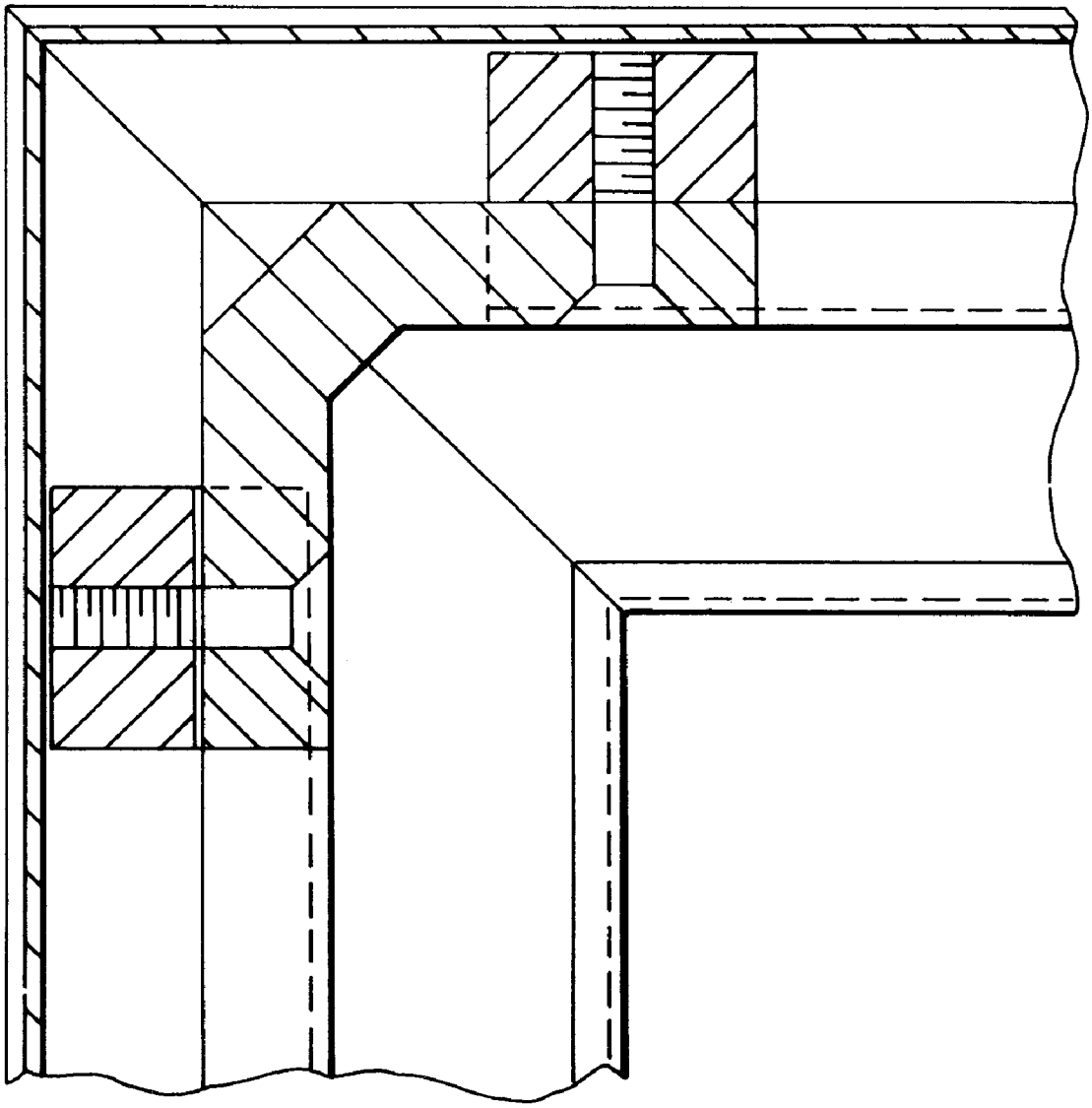
Figure 60:
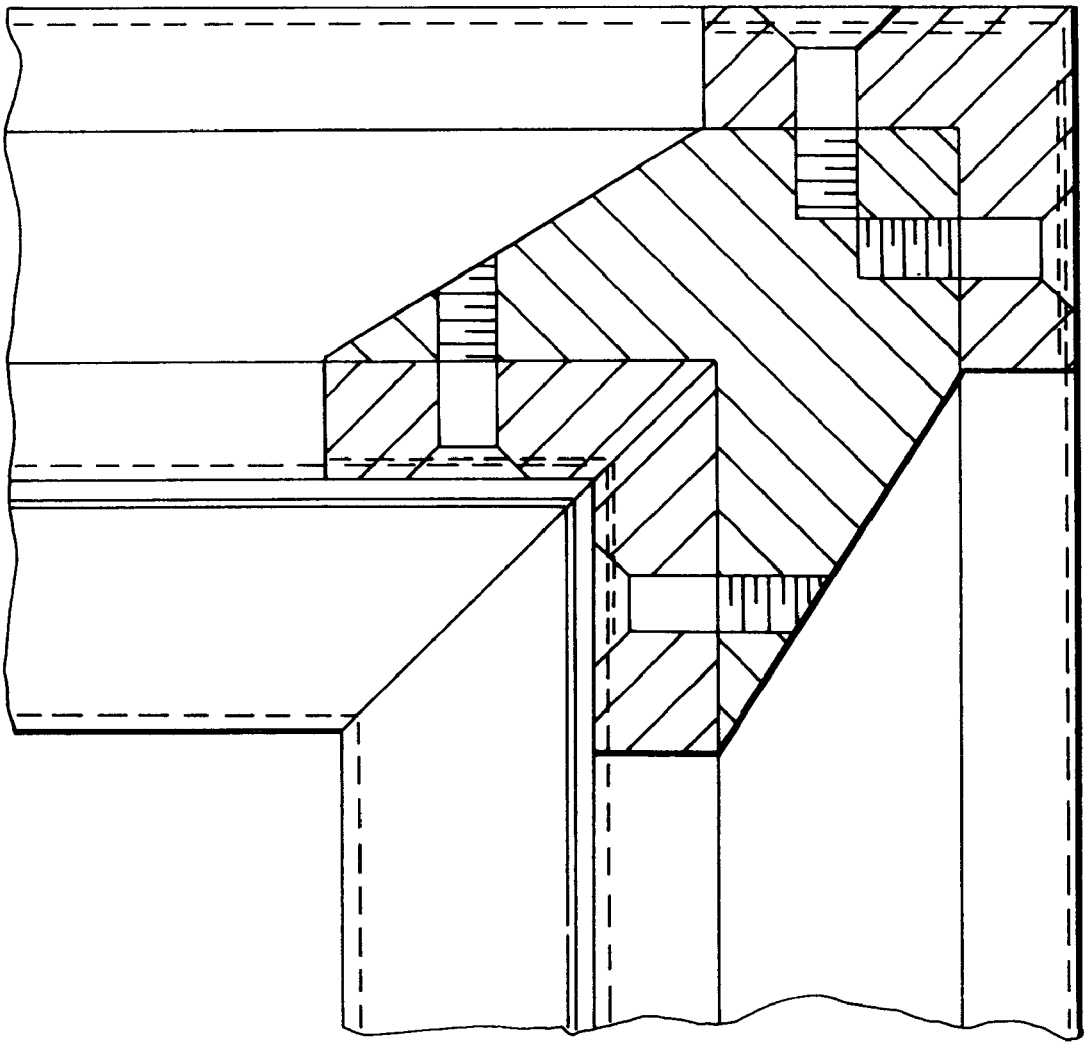

FIGS. 58 to 60 show some special components for the formation of rigid corners of casing frames. In particular, FIG. 58 shows a T-shaped fastening for a cross frame of a hinged casing between composite sections such as 114, 118A and 118, 118A (both composite sections), which may hold snap-on glass securing channel pieces 116. FIG. 59 shows a corner fastening for an external frame for a sliding casing with a section 102. FIG. 60 shows a corner fastening for a frame of a hinged casing between composite sections 114, 118A. The sections 106 connected with the device 110 will have a corner fastening similar to that shown in FIGS. 59 and 60.

Regardless of the embodiment, it is evident that the arrangement of the components described according to the invention and claimed below provides additional and substantial simplifications with respect to previously known solutions patented by the present patent holder and cited initially, and that it also provides additional means of meeting the various requirements of application of the concept of the invention.

It should be understood that the drawing shows only an example provided solely as a practical demonstration of the invention, and that this invention may be varied in its forms and arrangements without thereby departing from the scope of the guiding concept of the invention. Any reference numbers in the enclosed claims has the purpose of facilitating the reading of the claims with reference to the description and to the drawing, and does not limit the scope of protection represented by the claims.

What is claimed is:

1. Metal supporting structure comprising a cold-formed section which is a composite of a plurality of elementary sections which are permanently assembled together to form continuous longitudinal slots between opposed longitudinal edges of two elementary sections, said longitudinal edges facing inwards and each being inclined with respect to the opposite edge so that they converge inwardly; fixing devices having a receiving plate forming a channel with lateral walls inclined inwardly in a same way as said longitudinal edges and one or more locking plugs which also have lateral walls inclined inwardly in the same way as said edges, said receiving plate and said locking plugs being oppositely fixed between and along said longitudinal slots (27) to grip opposite edges of two said elementary sections by screw means between said receiving plates and said locking plugs, said longitudinal edges of the elementary sections being manufactured with corrugations corresponding to corrugations present in the lateral walls of the receiving plates and in the lateral walls of the locking plugs, said longitudinal edges of said elementary sections have said corrugations along a whole length of said longitudinal edges.

2. Structure according to claim 1, wherein:

said corrugations of said elementary sections are repeated at a constant interval corresponding to an interval of said corrugations present in the walls of the receiving plates and/or in the lateral walls of the locking plugs.

3. Structure according to claim 1, wherein:

said receiving plates and the plugs have at least one pin and one socket which mutually correspond to facilitate assembly without use of stiffening cross brackets.

4. Structure according to claim 1, further comprising:

anchors fitted with at least one captive pin projecting from a bottom of the channel for connection to a plug.

5. Structure according to claim 1, further comprising:

a double receiving plate with the channels having opposing inclined walls and with through holes in a bottom which is common to said channels.

6. Structure according to claim 1, further comprising:

bracket plugs whose width does not exceed that of the longitudinal slots, for connection of said elementary sections positioned at substantially right angles, in a T shape and with other intersections and/or convergences.

7. Structure according to claim 5, further comprising:

threaded rods which interconnect two of said double receiving plates of said elementary sections placed together in an orthogonal arrangement and formed by two C-shaped elementary sections.

8. Structure according to claim 1, further comprising:

receiving plates with end plates having lugs for receiving single or double C-shaped elementary sections.

9. Structure according to claim 1, to form adjacent sliding rails, wherein said elementary sections include two sections, one of which has two pairs of channels and both of which have inclined corrugated edges which can be connected with matrices and plugs.

10. Structure according to claim 1, wherein:

said elementary sections include sections for door or window casings, and for external frames, for sliding frames, and for hinged casings; and also hinges which can be fitted with plugs engaging with receiving plates.

11. Structure according to claim 1, further comprising:

bracket plugs to form comers of frames for T-shaped connections, for door or window casings.

12. A supporting structure arrangement comprising:

a plurality of elementary sections each having a longitudinal edge, said elementary sections being positionable relative to each other to have said longitudinal edges define a slot, said each longitudinal edge including a plurality of corrugations extending continuously along said longitudinal edge;

fixing devices positionable in said slot and for joining said longitudinal edges, said fixing devices including a receiving plate defining a channel for receiving said longitudinal edges, said channel having walls substantially complementary to said corrugations of said longitudinal edges, said fixing devices including a locking plug positionable between said longitudinal edges defining said slot, said locking plug having walls substantially complementary to said corrugations of said longitudinal edges;

clamp means for clamping said receiving plate and said locking plug together and causing said fixing device to attach to said longitudinal edges.

13. The arrangement in accordance with claim 12, wherein:

said corrugations in said longitudinal edges are substantially periodic.

14. The arrangement in accordance with claim 12, wherein:

said corrugations in said longitudinal edges are substantially regular and uniform.

15. The arrangement in accordance with claim 12, wherein:

said elementary sections are cold-formed;

said slot is between opposed said longitudinal edges of two said elementary sections, with said longitudinal edges facing inwards and each longitudinal edge being inclined with respect to an opposite edge to cause said longitudinal edges to converge inwardly;

said walls of said channel are inclined inwardly in a same way as said longitudinal edges;

said walls of said locking plugs are also incline inwardly in a same way as said longitudinal edges;

said longitudinal edges are positionable between said walls of said channel and said walls of said locking plugs;

said longitudinal edges of the elementary sections are manufactured with said corrugations.

16. The arrangement in accordance with claim 12, wherein:

said receiving plate and said locking plug have at least one pin and one socket which mutually correspond to facilitate assembly without use of stiffening cross brackets.

17. The arrangement in accordance with claim 12, wherein:

said receiving plate is fitted with a captive pin projecting from a bottom of said channel for connection to said locking plug.

18. The arrangement in accordance with claim 12, wherein:

said receiving plate defines two of said channels;

said receiving plates include end plates with lugs for receiving single or double C-shaped elementary sections;

said elementary sections are positioned to form adjacent sliding rails which are fittable to form covered lorries, said elementary sections including first and second sections, said first special section including two pairs of channels, said first and second sections including inclined corrugated edges connectable said receiving plate and said locking plug.

19. The arrangement in accordance with claim 12, further comprising:

a bracket plug with a width not greater than a width of said slot, said bracket plug having a T shape for connection of said elementary sections positioned at substantially right angles to each other.

20. The arrangement in accordance with claim 18, further comprising:

a threaded rod for connecting two of said receiving plates each defining two said channels, said two receiving plates being positioned together in a substantially orthogonal arrangement and formed by two C-shaped or equivalent elementary sections;

said elementary sections include sections for door or window casings, and for external frames, for sliding frames, and for hinged casings, and also hinges which can be fitted with plugs engageable with said receiving plate;

bracket plugs to form corners of frames for T-shaped connections, and for door or window casings.

* * * * *